US011976658B2

(12) United States Patent
Liu et al.

(10) Patent No.: US 11,976,658 B2
(45) Date of Patent: May 7, 2024

(54) ELECTRIC PUMP WITH COOLING CHANNEL ARRANGEMENT

(71) Applicant: ZHEJIANG SANHUA INTELLIGENT CONTROLS CO., LTD, Zhejiang (CN)

(72) Inventors: Lili Liu, Zhejiang (CN); Wei Ye, Zhejiang (CN)

(73) Assignee: ZHEJIANG SANHUA INTELLIGENT CONTROLS CO., LTD., Zhejiang (CN)

( * ) Notice: Subject to any disclaimer, the term of this patent is extended or adjusted under 35 U.S.C. 154(b) by 241 days.

(21) Appl. No.: 17/616,268

(22) PCT Filed: Jun. 8, 2020

(86) PCT No.: PCT/CN2020/094809
§ 371 (c)(1),
(2) Date: Dec. 3, 2021

(87) PCT Pub. No.: WO2020/253559
PCT Pub. Date: Dec. 24, 2020

(65) Prior Publication Data

US 2022/0325712 A1 Oct. 13, 2022

(30) Foreign Application Priority Data

Jun. 19, 2019 (CN) ..... 201910529233.3

(51) Int. Cl.
*F04C 2/10* (2006.01)

(52) U.S. Cl.
CPC ..... *F04C 2/102* (2013.01); *F04C 2240/30* (2013.01); *F04C 2240/40* (2013.01); *F04C 2240/603* (2013.01)

(58) Field of Classification Search
CPC .. F04C 2/102; F04C 2240/30; F04C 2240/40; F04C 2240/603
See application file for complete search history.

(56) References Cited

U.S. PATENT DOCUMENTS 10,914,305 B2 * 2/2021 Rosinski ..... F04D 13/0653
2003/0161738 A1 * 8/2003 Kimberlin ..... H02K 5/128 417/307

(Continued)

FOREIGN PATENT DOCUMENTS

CN 1643258 A 7/2005
CN 106151054 A 11/2016

(Continued)

OTHER PUBLICATIONS

Chinese Office Action dated Apr. 16, 2021 for Chinese Appl. No. 201910529233.3.

(Continued)

*Primary Examiner* — Nathan C Zollinger
(74) *Attorney, Agent, or Firm* — Ohlandt, Greeley and Perle, LLP

(57) ABSTRACT

An electric pump including a pump shaft, a first rotor assembly, a stator assembly, and a second rotor assembly. The first rotor assembly is arranged in a first accommodation cavity, the stator assembly and the second rotor assembly are arranged in a second accommodation cavity; the electric pump further comprises a first channel and a second channel, the first channel passes through the upper and lower surfaces of the bottom wall of a first accommodation portion, the first channel can communicate with first accommodation cavity and the second accommodation cavity, at least part of a work medium in the first accommodation cavity can flow into the second accommodation cavity through the first channel, the second channel is arranged to penetrate through a first end (Continued)

face of the pump shaft and a second end face of the pump shaft.

15 Claims, 10 Drawing Sheets

(56) References Cited

U.S. PATENT DOCUMENTS

| | | | | |
|---|---|---|---|---|
| 2004/0219035 | A1 | 11/2004 | Hundt et al. | |
| 2013/0294940 | A1 | 11/2013 | Matz et al. | |
| 2013/0302142 | A1* | 11/2013 | Chiu | F04D 29/061 415/115 |
| 2016/0281718 | A1 | 9/2016 | Zhang et al. | |
| 2017/0343098 | A1 | 11/2017 | Rosinski | |
| 2019/0003477 | A1* | 1/2019 | Graves | F04C 2/104 |
| 2019/0170140 | A1 | 6/2019 | Yamaguchi | |
| 2019/0234404 | A1 | 8/2019 | Homma et al. | |
| 2020/0300241 | A1 | 9/2020 | Lu et al. | |

FOREIGN PATENT DOCUMENTS

| | | | |
|---|---|---|---|
| CN | 109113946 | A | 1/2019 |
| CN | 109113954 | A | 1/2019 |
| CN | 109424539 | A | 3/2019 |
| CN | 109563828 | A | 4/2019 |
| EP | 1478854 | B1 | 12/2005 |
| EP | 1443210 | B1 | 8/2006 |
| JP | 2006170119 | A | 6/2006 |
| JP | 2014001637 | A | 1/2014 |
| JP | 2018025127 | A | 2/2018 |
| KR | 20170128823 | A | 11/2017 |
| WO | 2012066483 | A2 | 5/2012 |
| WO | 2018062093 | A1 | 4/2018 |

OTHER PUBLICATIONS

European Search Report dated Jun. 9, 2023 for European Appl. No. 20825824.4.

International Search Report dated Jul. 29, 2020 for PCT application No. PCT/CN2020/094809.

Japanese Office Action dated Dec. 20, 2022 for Japanese Appl. No. 2021-571333.

* cited by examiner

ELECTRIC PUMP WITH COOLING CHANNEL ARRANGEMENT

The present application is a National Phase entry of PCT Application No. PCT/CN2020/094809, filed on Jun. 8, 2020, which claims priority of Chinese Patent Application No. 201910529233.3, titled "ELECTRIC PUMP", filed with the China National Intellectual Property Administration on Jun. 19, 2019, which is incorporated herein by reference in its entirety.

FIELD

The present application relates to the technical field of vehicles, and in particular to an assembly of a lubrication system and/or a cooling system of a vehicle.

BACKGROUND

An electric pump is widely applied to a lubrication system and/or a cooling system of a vehicle, and the electric pump is capable of well meeting market requirements.

The electric pump mainly provides a power source for the lubrication system and/or the cooling system of the vehicle. The electric pump includes a stator assembly, which may generate heat during operation. In a case that heat is accumulated to a certain extent and fails to be dissipated in time, the stator assembly may be affected, which further reduces the service life of the electric pump.

SUMMARY

An object of the present application is to provide an electric pump, which is beneficial for the heat dissipation of the stator assembly, thereby being beneficial for improvement of the service life of the electric pump.

In order to achieve the above object, the following technical solution is provided according to an implementation manner of the present application.

An electric pump, includes a pump shaft, a first rotor assembly, a stator assembly, and a second rotor assembly; and one end of the pump shaft is fixedly connected to a part of the first rotor assembly, and the other end of the pump shaft is connected to the second rotor assembly; a first accommodation portion and a second accommodation portion are provided on the electric pump, the first accommodation portion is provided with a first accommodation cavity, and the second accommodation portion is provided with a second accommodation cavity; the first rotor assembly is provided inside the first accommodation cavity, the stator assembly and the second rotor assembly are provided inside the second accommodation cavity; the first accommodation portion includes a bottom wall configured to support the first rotor assembly; the electric pump includes a first channel that penetrates through an upper surface and a lower surface of the bottom wall, the first channel is configured to communicate the first accommodation cavity with the second accommodation cavity; a working medium is configured to circulate in the first accommodation cavity, and at least part of the working medium inside the first accommodation cavity is configured to flow into the second accommodation cavity through the first channel and be in contact with at least part of the stator assembly located inside the second accommodation cavity; the electric pump further includes a second channel provided to penetrate through a first end surface and a second end surface of the pump shaft, and the second channel enables the working medium in the second accommodation cavity to leave the second accommodation cavity; the electric pump further includes an inflow channel and an outflow channel, where the inflow channel is configured to enable an inflow of the working medium, and the outflow channel is configured to enable an outflow of the working medium; an outlet of the second channel is closer to the inflow channel than an inlet of the first channel, and a pressure of the working medium at the outlet of the second channel is lower than a pressure of the working medium at the inlet of the first channel; the electric pump further includes a branch channel configured to communicate the outflow channel with the second channel.

In this technical solution, the electric pump includes a first channel and a second channel, where the first channel is configured to communicate the first accommodation cavity with the second accommodation cavity. At least part of the working medium inside the first accommodation cavity is configured to flow into the second accommodation cavity through the first channel and be in contact with at least part of the stator assembly located inside the second accommodation cavity. The second channel is provided to penetrate through the first end surface and the second end surface of the pump shaft. And the second channel enables the working medium in the second accommodation cavity to leave the second accommodation cavity. The outlet of the second channel is closer to the inflow channel than an inlet of the first channel, and the pressure of the working medium at the outlet of the second channel is lower than the pressure of the working medium at the inlet of the first channel. The electric pump further includes a branch channel, which is configured to communicate the outflow channel with the second channel, so that the working medium in the second accommodation cavity may flow. Since the stator assembly is arranged inside the second accommodation cavity, the flowing working medium can take away part of the heat of the stator assembly, which is beneficial for the heat dissipation of the stator assembly, thereby being beneficial for improve the service life of the electric pump.

DETAILED DESCRIPTION OF THE EMBODIMENTS

In order to enable those skilled in the art to better understand the technical solutions of the present application, the present application will be further described in detail below with reference to the accompanying drawings and specific embodiments.

The electric pump in this embodiment mainly provide flowing power for the working medium of the lubrication system and/or cooling system of a vehicle, and specifically provide flowing power for the working medium of the lubrication system and/or cooling system in a transmission system of the vehicle.

Figure 1:
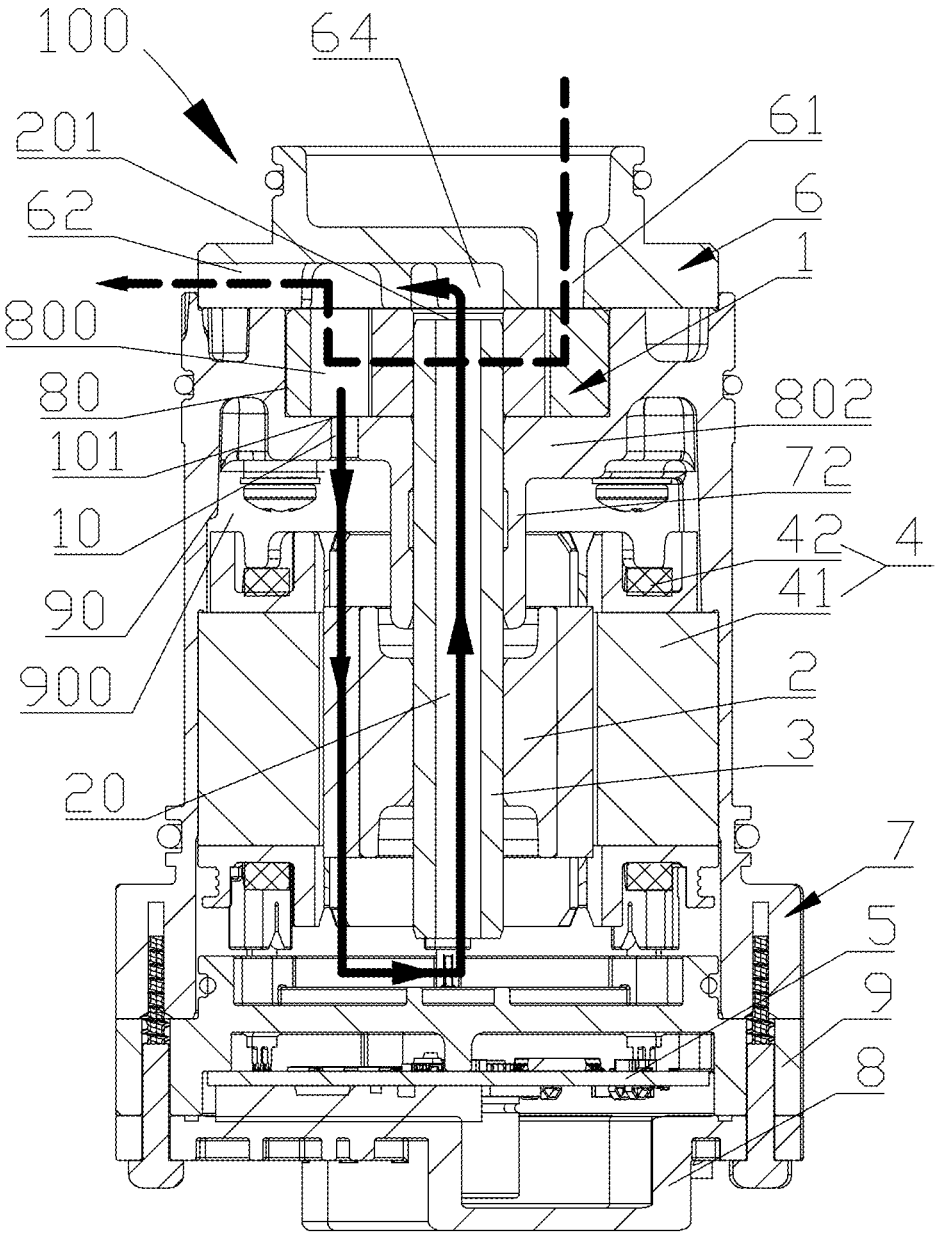
FIG. 1 is a schematic cross-sectional structural view of a first embodiment of an electric pump provided according to the present application.

Referring to FIG. 1, the electric pump 100 includes a pump casing, a first rotor assembly 1, a stator assembly 4, a second rotor assembly 2, a pump shaft 3, and an electric control board 5. The first rotor assembly 1, the second rotor assembly 2, the stator assembly 4 and the electric control board 5 are arranged along an axial direction of the electric pump 100, and the second rotor assembly 2 is located between the first rotor assembly 1 and the electric control board 5. A first accommodation portion 80 and a second accommodation portion 90 are provided on the electric pump 100, the first accommodation portion 80 is provided with a first accommodation cavity 800, and the second accommodation portion 90 is provided with a second accommodation cavity 900. The first rotor assembly 1 is provided inside the first accommodation cavity 800; the stator assembly 4 and the second rotor assembly 2 are provided inside the second accommodation cavity 900. The stator assembly 4 is located on the outer periphery of the second rotor assembly 2. The first rotor assembly 1 is located towards one end of the pump shaft 3 and is connected to the pump shaft 3; the second rotor assembly 2 is located towards the other end of the pump shaft 3 and is connected to the pump shaft 3. Referring to FIG. 1, the stator assembly 4 includes a stator iron core 41 and a coil 42. During the operation of the electric pump 100, the electric control board 5 controls the current through the coil 42 of the stator assembly 4 according to a predetermined rule, so as to control the stator assembly 4 to generate a varying excitation magnetic field. The second rotor assembly 2 is configured to rotate under the action of the excitation magnetic field. The second rotor assembly 2 is capable of directly or indirectly driving the first rotor assembly 1 to rotate. When the first rotor assembly 1 rotates, a volume of the volume cavity between the rotor assemblies 1 is changed, so that the working medium is forced out to the outflow channel to generate a power for flowing.

Referring to FIG. 1, the pump casing includes a pump cover 6, a first casing 7 and a second casing 8. The pump cover 6 is relatively fixedly connected to the first casing 7, and the first casing 7 is relatively fixedly connected to the second casing 8. Specifically, in this embodiment, the pump cover 6 and the first casing 7 are connected by screws or bolts. Of course, the pump cover 6 and the first casing 7 may also be connected in other ways, such as plug-in connection, stuck connection, etc. The first casing 7 and the second casing 8 are connected by screws or bolts. Specifically, in this embodiment, a part of a spacer 9 is located between the first casing 7 and the second casing 8, and the screws or bolts pass through the second casing 8, the spacer 9 and the first casing 7 in sequence, so that the first casing 7 and the second casing 8 are indirectly fixedly connected. Of course, the first casing 7 and the second casing 8 may also be directly fixedly connected by screws or bolts. In this case, the structure of the spacer 9 may be changed accordingly. For example, but not limited to, the spacer 9 may be positioned by tightly fitting with an inner peripheral side wall of the first casing 7. The first casing 7 and the second casing 8 are connected by screws or bolts to facilitate the disassembly and assembly of the electric pump. In this embodiment, the electric control board 5 is arranged inside a cavity between the first casing 8 and the spacer 9, which is further beneficial for the maintenance of the electric control board 5 in the electric pump. Of course, the first casing 7 and the second casing 8 may also be connected by plug-in connection, stuck connection, etc. In addition, in this embodiment, the first accommodation portion 80 and the second accommodation portion 90 are formed on the pump casing. Specifically, the first accommodation portion 80 is formed between the pump cover 6 and the first casing 7. The second accommodation portion 90 is formed between the first casing 7 and the second casing 8. Of course, the pump casing may not be included. Instead, other parts except the pump casing are directly assembled with a gearbox of the vehicle. In this case, a partition portion may be provided. On one hand, the partition portion is configured to support the first rotor assembly 1; on the other hand, the partition portion is configured to serve as a partition between the first accommodation portion 80 and the second accommodation portion 90.

Figure 2:
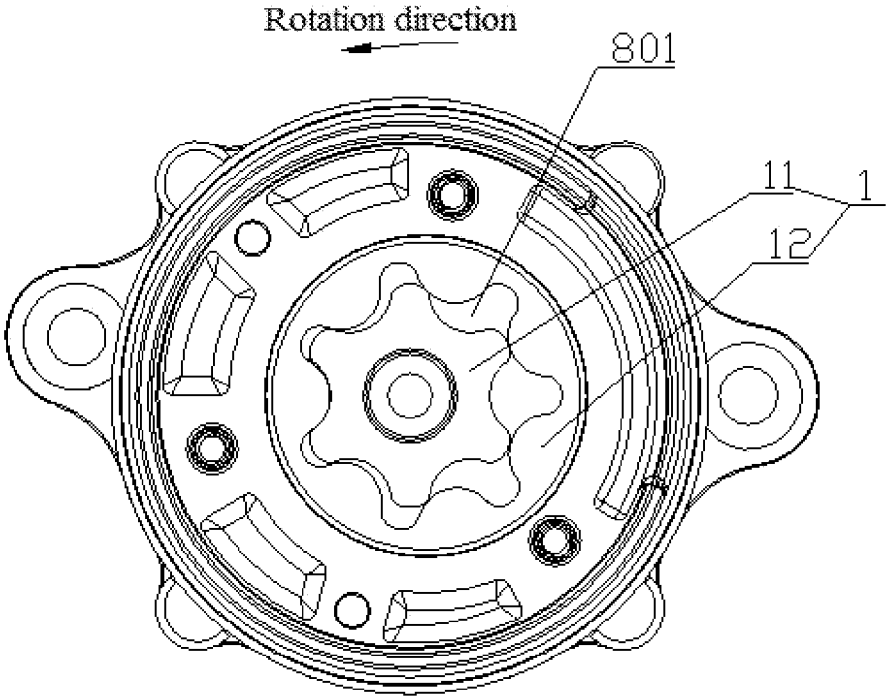
FIG. 2 is a schematic front view of a partial structure of the electric pump in FIG. 1 without a pump cover.

Referring to FIG. 2, in this embodiment, the first rotor assembly 1 includes a first rotor 11 and a second rotor 12. The first rotor 11 is provided with multiple external teeth, and the second rotor 12 is provided with multiple internal teeth. The first rotor 11 is fixedly connected to the pump shaft 3 in FIG. 1. The second rotor 12 is located on the outer circumference of the first rotor 11. A Volume cavity 801 are formed between the external teeth of the first rotor 11 and the internal teeth of the second rotor 12, and the volume cavity 801 are also a part of the first accommodation cavity. In this embodiment, a certain eccentric distance is present between the first rotor 11 and the second rotor 12. When the first rotor 11 rotates, at least part of the external teeth of the first rotor 11 engage with at least part of the internal teeth of the second rotor 12, so that the first rotor 11 is capable of driving the second rotor 12 to rotate. Reference is made back to FIG. 1 and FIG. 2 again. The electric pump 100 further includes an inflow channel 61 and an outflow channel 62. The inflow channel 61 is used for the inflow of the working medium, and the outflow channel 62 is used for the outflow of the working medium. Specifically, the working medium may enter the volume cavity 801 through the inflow channel 61, and the working medium may leave the volume cavity 801 through the outflow channel 62. In this embodiment, the inflow channel 61 and the outflow channel 62 are both defined in the pump cover 6. Of course, in a case that the pump cover 6 is not included, components other than the pump cover 6 may be directly assembled with the gearbox of the vehicle. In this case, the inflow channel 61 and the outflow channel 62 may be correspondingly defined in the gearbox. Referring to FIG. 2, during one rotation of the first rotor assembly 1, volume of a volume cavity formed between at least one external teeth of the first rotor 11 and the internal teeth of the second rotor 12 corresponding to the external teeth may change. Specifically, during a process that the first rotor assembly 1 rotates from beginning to a certain angle, the volume of the volume cavity formed between at least one external teeth of the first rotor 11 and the internal teeth of the second rotor 12 corresponding to the external teeth gradually increases to form a partial vacuum. At this time, the working medium is sucked into the volume cavity 801 through the inflow channel 61. During a process that the first rotor 11 and the second rotor 12 continue to rotate, the volume of the volume cavity formed between at least one external teeth of the first rotor 11 and the internal teeth of the second rotor 12 corresponding to the external teeth gradually decreases, and the working medium may be squeezed, so that the working medium entering the volume cavity 801 is squeezed out to the outflow channel 62, thereby generating a power for flow.

Referring to FIG. 1, the first accommodation portion 80 includes a bottom wall 802 configured to support the first rotor assembly 1. The first accommodation cavity 800 is located on one side of the bottom wall 802, and the second accommodation cavity 900 is located on the other side of the bottom wall 802. The electric pump 100 further includes a first channel 10 that penetrates through an upper surface and a lower surface of the bottom wall 802. The first channel 10 is configured to communicate the first accommodation cavity 800 with the second accommodation cavity 900. A working medium may circulate in the first accommodation cavity 800, and at least part of the working medium inside the first accommodation cavity 800 is configured to flow into the second accommodation cavity 900 through the first channel 10 and be in contact with at least part of the stator assembly 4 located inside the second accommodation cavity 900. The electric pump 100 further includes a second channel 20 provided to penetrate through a first end surface and a second end surface of the pump shaft 3. The electric pump 100 further includes a branch channel 64, which is in communication with the outflow channel 62 and is configured to communicate the second channel 20 with the outflow channel 62. The second channel 20 enables the working medium in the second accommodation cavity 900 to leave the second accommodation cavity 900. An outlet 201 of the second channel 20 is closer to the inflow channel 61 than an inlet 101 of the first channel 10, and a pressure of the working medium at the outlet 201 of the second channel 20 is lower than a pressure of the working medium at the inlet 101 of the first channel 10, so that a pressure difference of the working medium is formed at the inlet 101 of the first channel 10 and the outlet 201 of the second channel 20. According to a principle that the working medium flows from a position with high pressure to a position with low pressure, the working medium in the second accommodation cavity 900 may flow towards the outlet 201 of the second channel 20. Since the stator assembly 4 is provided inside the second accommodation cavity 900, the flowing working medium can take away at least part of the heat of the stator assembly 4, which is beneficial for the heat dissipation of the stator assembly 4, thereby being beneficial for the improvement of the service life of the electric pump. Reference is made to the following for a detailed description of the "outflow channel 62" and the "branch channel 64".

Referring to FIG. 1, the first casing 7 further includes a pump shaft supporting portion 72 formed integrally with the bottom wall 802. The pump shaft supporting portion 72 protrudes from the lower surface of the bottom wall 802 in a direction away from the lower surface of the bottom wall 802, and the pump shaft 3 passes through the pump shaft supporting portion 72. The second channel 20 is configured to communicate the second accommodation cavity 900 with the branch channel 64. The arrangement of providing the second channel 20 on the pump shaft 3 is relatively simple in structure.

Reference is made to FIG. 1, which shows flow directions of the working medium. Specifically, the working medium has two flow directions. In order to better illustrate the flow directions of the working medium, a thick dashed line in FIG. 1 is a first flow direction, and a thick solid line is a second flow direction. In the first flow direction, the working medium flows from the inflow channel 61 into volume cavities in the first rotor assembly 1, and flows out of the volume cavities from the outflow channel 62. In the second flow direction, a part of the working medium that enters the volume cavities in the first rotor assembly 1 flows from the first channel 10 to the second accommodation cavity 900; the working medium in the second accommodation cavity 900 flows out from the second channel 20 to the branch channel 64, and flows out from the branch channel 64 to the outflow channel 62. In this embodiment, an inflow direction of the working medium is a vertical direction, and an outflow direction of the working medium is a horizontal direction, in which the "vertical direction" and the "horizontal direction" are directions in a case that the electric pump is arranged in the state shown in FIG. 1.

Figure 3:
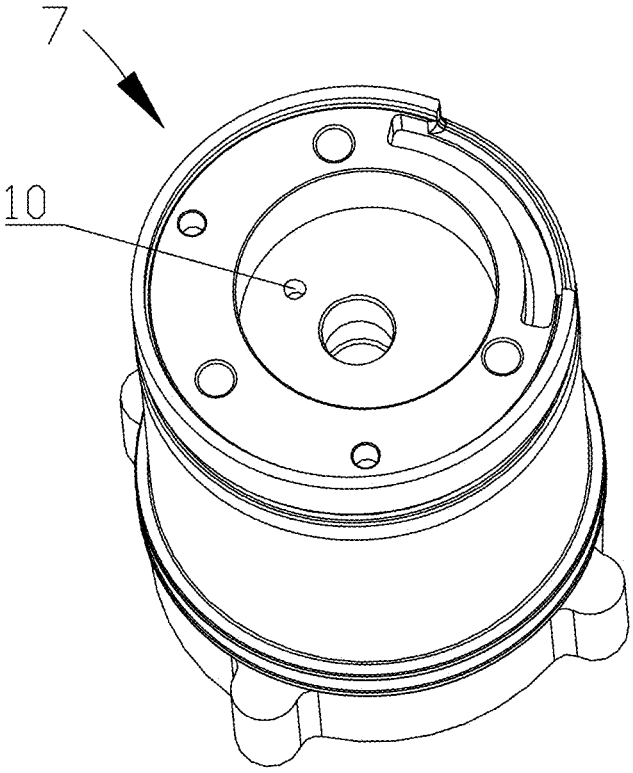
FIG. 3 is a three-dimension structural view of a first casing in FIG. 1 from a perspective.
Figure 4:
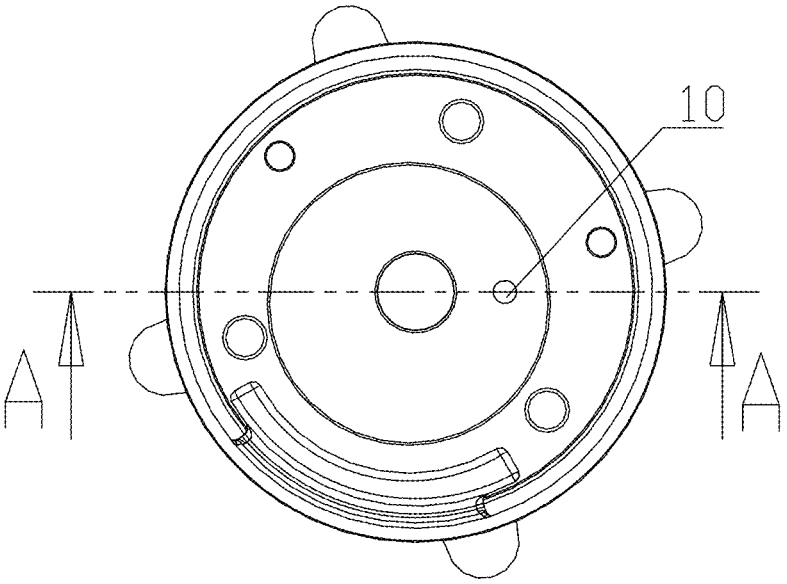
FIG. 4 is a schematic front view of the first casing in FIG. 3.
Figure 5:
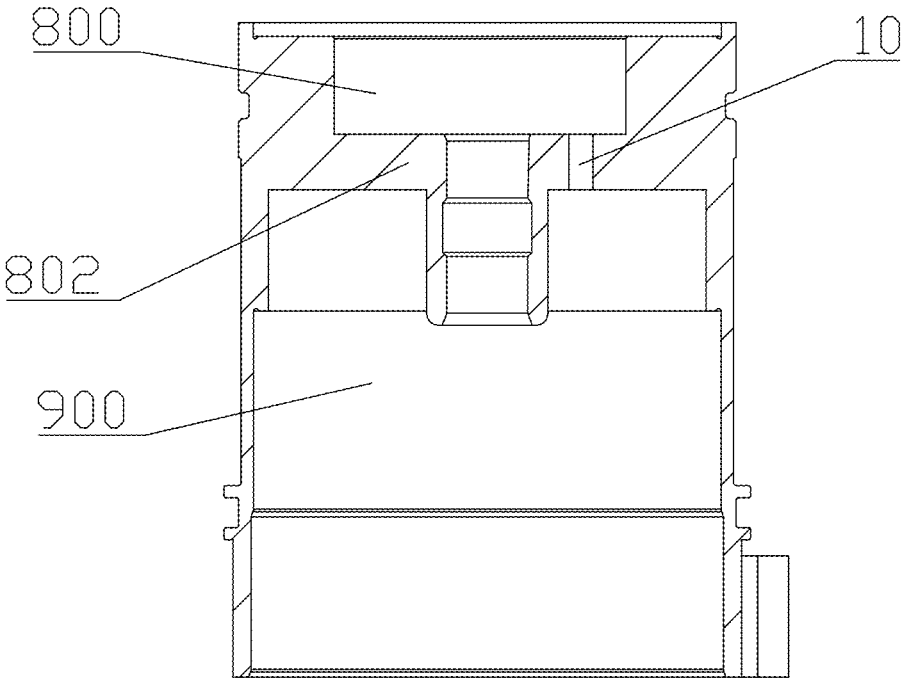
FIG. 5 is a schematic cross-sectional structural view of the first casing in FIG. 4 at an A-A section.
Figure 6:
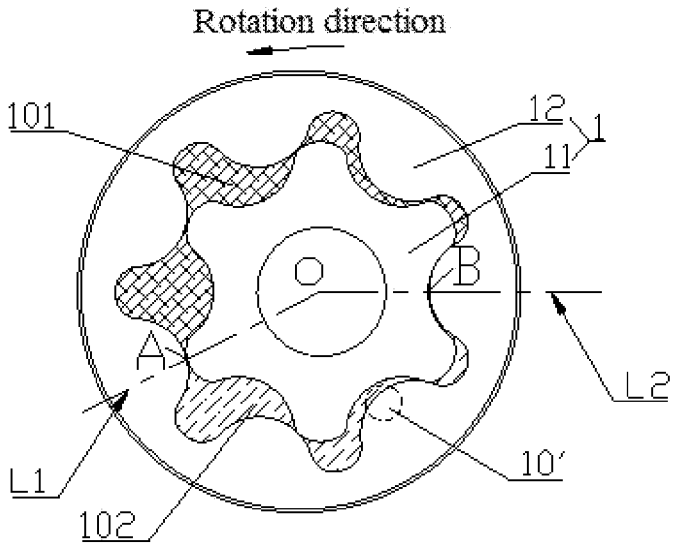
FIG. 6 is a schematic front view formed by orthographically projecting a first rotor assembly in FIG. 1 to a bottom wall in FIG. 4.

Referring to FIG. 1 to FIG. 6, FIG. 1 is a schematic structural view of the first embodiment of the electric pump provided according to the present application; FIG. 3 to FIG. 5 are structural schematic views of the first casing in FIG. 1; FIG. 6 is schematic projection view formed by orthographically projecting the first rotor assembly in FIG. 1 to the bottom wall of the first accommodation portion in FIG. 4. The structure of the first embodiment of the electric pump will be described in detail below.

Referring to FIG. 6, a volume cavity may be formed between an external tooth of the first rotor 11 and an internal tooth of the second rotor 12. The volume cavity is divided into a first area 101 and a second area 102. In order to better differentiate the first area 101 and the second area 102, referring to FIG. 6, the first area 101 and the second area 102 are differentiated by two different section lines respectively. In this embodiment, the first rotor assembly rotates in a counterclockwise direction, in which the "counterclockwise" here refers to a rotation direction in a case that the electric pump without being cut is seen from a top view when the electric pump is arranged in the state shown in FIG. 1. In the first area 101, along the rotation direction of the first rotor assembly 1, a volume of the volume cavity formed between one external tooth of the first rotor 11 and one internal tooth of the second rotor 12 corresponding to the external tooth gradually increase, so that a partial vacuum may be formed in the first area 101. With reference to FIG. 1, the working medium is now sucked into the first area 101 from the inflow channel 61. In the second area 102, along the rotation direction of the first rotor assembly 1, the volume of the volume cavity formed between one external tooth of the first rotor 11 and one internal tooth of the second rotor 12 corresponding to the external tooth gradually decrease, so that the working medium 102 is squeezed in the second area 102, and the pressure of the working medium in the second area 102 gradually increases. Referring to FIG. 6, in a case that the first rotor assembly 1 is orthographically projected to the bottom wall 802 of the first accommodation portion, at least part of the projection 10' of the first channel is located inside the second area 102. However, in this embodiment, the pressure in the second area 102 is greater than the pressure in the second accommodation cavity 900 in FIG. 1, so that the working medium to be flowed into the second accommodation cavity 900 in FIG. 1 stays at a position with relatively high pressure. According to the principle that the working medium flows from a position with high pressure to a position with low pressure, at least part of the working medium in the first accommodation cavity 800 can flow into the second accommodation cavity 900 through the first channel 10. Referring to FIG. 3 and FIG. 4, in this embodiment, the cross-section of the first channel 10 is a circular hole, of course, the first channel 10 may also be in a square hole shape or other closed patterns.

Referring to FIG. 4 to FIG. 6, in a case that the first rotor assembly 1 is orthographically projected to the bottom wall 802 of the first accommodation portion, a first dividing line L1 is defined in a projection of the first rotor assembly 1, a first engaging point A is formed at the first dividing line L1 by an external tooth of the first rotor 11 engaging with an internal tooth of the second rotor 12, and the first dividing line L1 is a line connecting the first engaging point A and the center O of the first rotor 11. A second dividing line L2 is defined, a second engaging point B is formed at the second dividing line L2 by another external tooth of the first rotor 11 engaging with another internal tooth of the second rotor 12, and the second dividing line L2 is a line connecting the second engaging point B and the center O of the first rotor 11. The first dividing line L1 and the second dividing line L2 are dividing lines between the first area 101 and the second area 102, in which the first dividing line L1 is served as a dividing line between the ending of the first area 101 and the beginning of the second area 102, and the second dividing line L2 is served as a dividing line between the beginning of the first area 101 and the ending of the second area 102, in which the "beginning of the first area 101" and the "ending of the first area 101" refer to a beginning and an ending in the rotation direction of the first rotor 1, in which the "beginning of the second area 102" and the "ending of the second area 102" refer to a beginning and an ending in the rotation direction of the first rotor 1. Specifically, in this embodiment, the first rotor assembly 1 rotates in a counterclockwise direction, in which the "counterclockwise" here refers a rotation direction in a case that the electric pump without being cut is seen from a top view when the electric pump is arranged in the state shown in FIG. 1. In this embodiment, the projection 10' of the first channel is located closer to the second dividing line L2 than the first dividing line L1. Since the pressure of the working medium in the second area 102 gradually increases as the first rotor assembly 1 rotating, the pressure of the working medium located relatively closer to the second dividing line L2 is greater than the pressure of the working medium located relatively closer to the first dividing line L1. In other words, along the counterclockwise direction, the pressure of the working medium in the second area 102 gradually increases from the first dividing line L1 to the second dividing line L2. In addition, the projection 10' of the first channel is located closer to the second dividing line L2 relative to the first dividing line L1, which can relatively increase the pressure difference of the working medium entering the second accommodation cavity 900, so that the working medium can effectively flow into the second accommodation cavity 900, thereby further enabling the working medium to be in contact with the stator assembly 4 inside the second accommodation cavity 900, thereby facilitating the heat dissipation of the stator assembly 4.

Figure 7:
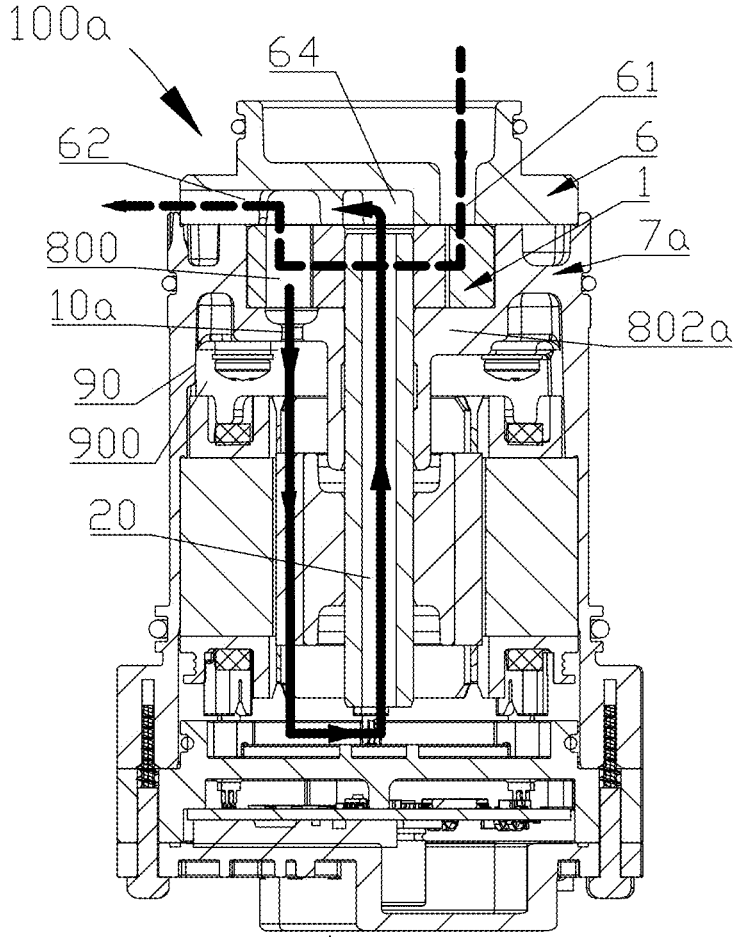
FIG. 7 is a schematic cross-sectional structural view of a second embodiment of an electric pump provided according to the present application.
Figure 8:
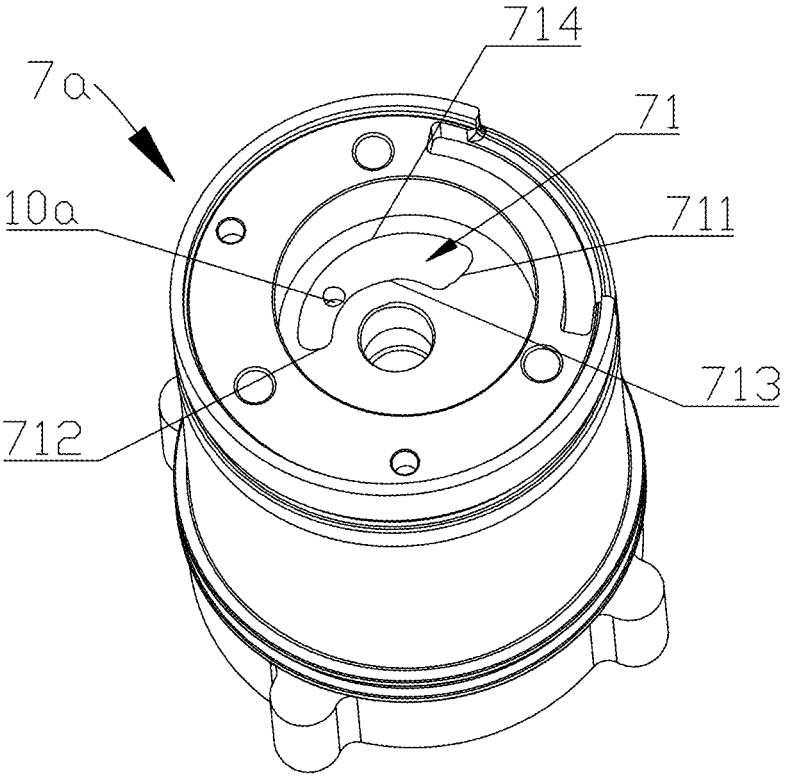
FIG. 8 is a three-dimension structural view of a first casing in FIG. 7 from a perspective.
Figure 9:
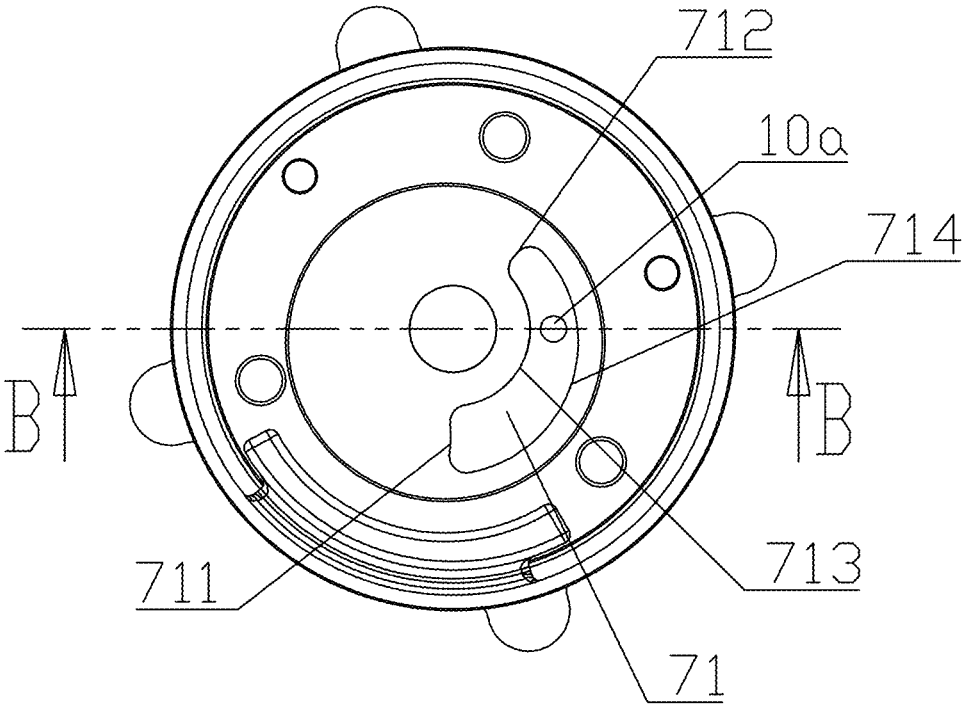
FIG. 9 is a schematic front view of the first casing in FIG. 8.
Figure 10:
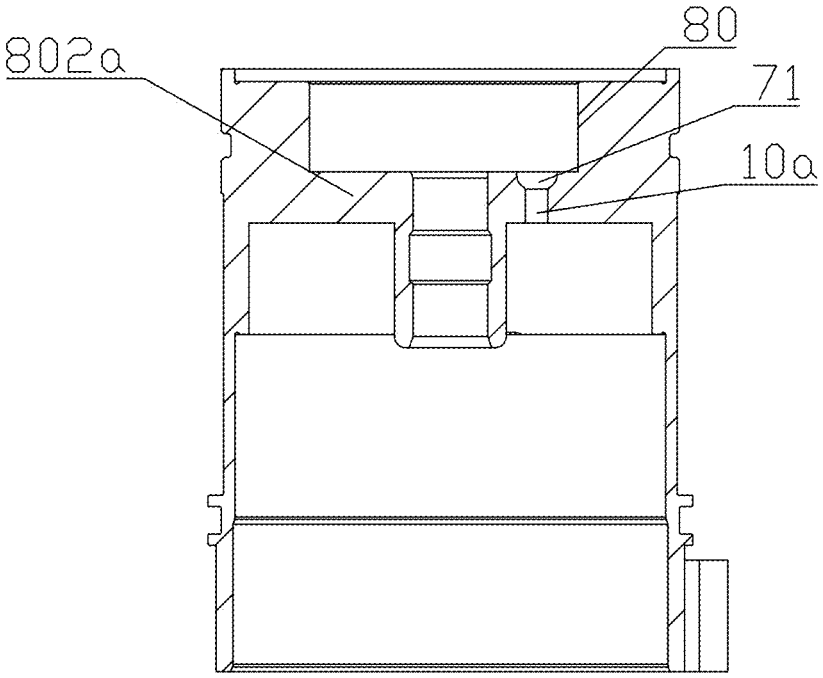
FIG. 10 is a schematic cross-sectional structural view of the first casing in FIG. 9 at an A-A section.

Referring to FIG. 7 to FIG. 11, FIG. 7 is a schematic structural view of the second embodiment of the electric pump provided according to the present application; FIG. 8 to FIG. 10 are structural schematic views of the first casing in FIG. 7; FIG. 6 is schematic projection view formed by orthographically projecting the first rotor assembly in FIG. 7 to the bottom wall of the first accommodation portion in FIG. 8. The structure of the second embodiment of the electric pump will be described in detail below.

Figure 11:
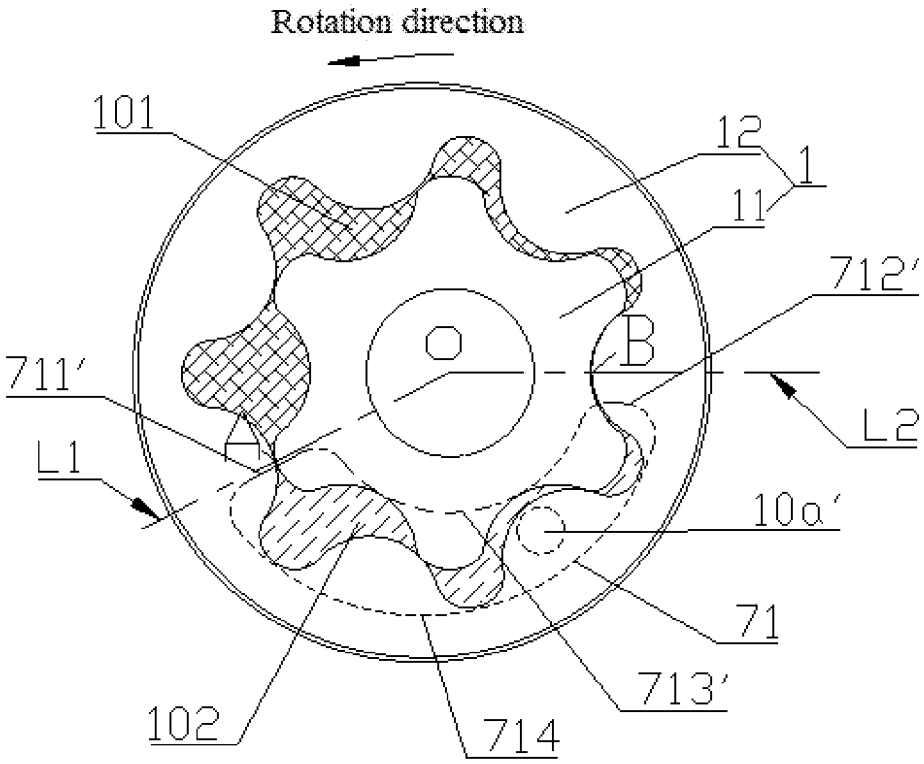
FIG. 11 is schematic front view formed by orthographically projecting a first rotor assembly in FIG. 7 to a bottom wall in FIG. 9.

Referring to FIG. 11, a volume cavity may be formed between an external tooth of the first rotor 11 and an internal tooth of the second rotor 12. The volume cavity is divided into a first area 101 and a second area 102. In order to better differentiate the first area 101 and the second area 102, referring to FIG. 11, the first area 101 and the second area 102 are differentiated by two different section lines respectively. In this embodiment, the first rotor assembly rotates in a counterclockwise direction, in which the "counterclockwise" here refers to a rotation direction in a case that the electric pump without being cut is seen from a top view when the electric pump is arranged in the state shown in FIG. 1. In the first area 101, along the rotation direction of the first rotor assembly 1, a volume of the volume cavity formed between one external tooth of the first rotor 11 and one internal tooth of the second rotor 12 corresponding to the external tooth gradually increase, so that a partial vacuum may be formed in the first area 101. With reference to FIG. 7, the working medium is sucked into the first area 101 from the inflow channel 61 at this time. In the second area 102, along the rotation direction of the first rotor assembly 1, the volume of the volume cavity formed between one external tooth of the first rotor 11 and one internal tooth of the second rotor 12 corresponding to the external tooth gradually decrease, so that the working medium 102 is squeezed in the second area 102, and the pressure of the working medium in the second area 102 gradually increases. Referring to FIG. 10 and FIG. 11, in a case that the first rotor assembly 1 is orthographically projected to the bottom wall 802*a* of the first accommodation portion, a first dividing line L1 is defined in a projection of the first rotor assembly 1, a first engaging point A is formed at the first dividing line L1 by an external tooth of the first rotor 11 engaging with an internal tooth of the second rotor 12, and the first dividing line L1 is a line connecting the first engaging point A and the center O of the first rotor 11. A second dividing line L2 is defined, a second engaging point B is formed at the second dividing line L2 by another external tooth of the first rotor 11 engaging with another internal tooth of the second rotor 12, and the second dividing line L2 is a line connecting the second engaging point B and the center O of the first rotor 11. The first dividing line L1 and the second dividing line L2 are dividing lines between the first area 101 and the second area 102, in which the first dividing line L1 is served as a dividing line between the ending of the first area 101 and the beginning of the second area 102, and the second dividing line L2 is served as a dividing line between the beginning of the first area 101 and the ending of the second area 102, in which the "beginning of the first area 101" and the "ending of the first area 101" refer to a beginning and an ending in the rotation direction of the first rotor 1, in which the "beginning of the second area 102" and the "ending of the second area 102" refer to a beginning and an ending in the rotation direction of the first rotor 1. Specifically, in this embodiment, the first rotor assembly 1 rotates in a counterclockwise direction, in which the "counterclockwise" here refers a rotation direction in a case that the electric pump without being cut is seen from a top view when the electric pump is arranged in the state shown in FIG. 1.

Referring to FIG. 8 to FIG. 10, a first groove 71 is defined in the bottom wall 802*a*. The first groove 71 recesses from an upper surface of the bottom wall 802*a* to a lower surface of the bottom wall 802*a*, and the first groove 71 does not penetrate through the lower surface of the bottom wall 802*a*. The first channel 10*a* locates inside the first groove 71, and the first channel 10*a* penetrates through the bottom surface of the first groove 71 and the lower surface of the bottom wall 802*a*. Referring to FIG. 10 and FIG. 11, in a case that the first rotor assembly 1 is orthographically projected to the bottom wall 802*a*, at least part of the second area 102 is located inside a projection of the first groove 71. With the arrangement of the first groove 71, part of the working medium is enabled to be located inside the first groove 71 during the working process of the electric pump, so as to be able to form an oil film between the first rotor assembly and the bottom wall 802*a*, thereby being beneficial for reducing the friction force between the first rotor assembly and the bottom wall 802*a* during rotation, thereby being beneficial for reducing noise caused by the friction. On the other hand, in this embodiment, since the first groove 71 is located in a position of the volume cavity where the pressure is relatively high, the first channel 10*a* is provided inside the first groove 71, which is beneficial for increasing the pressure difference of the working medium entering the second accommodation cavity 900, thereby facilitating part of the working medium in the first accommodation cavity 800 flowing into the second accommodation cavity 900 in FIG. 7.

Referring to FIG. 8 to FIG. 11, the first groove 71 includes a first head 711 and a first tail 712. During the operation of the electric pump, along the rotation direction of the first rotor assembly, the working medium flows from the first head 711 to the first tail 712 in the second area 102. Referring to FIG. 11, in a case that the first rotor assembly 1 is orthographically projected to the bottom wall 802*a* of the first accommodation portion, a projection 711' of the first head is closer to the first dividing line L1 than the second dividing line L2, and a projection 712' of the first tail is closer to the second dividing line L2 than the first dividing line L1. Of course, the projection 711' of the first head may also be coincided with the first dividing line L1, and the projection 712' of the first tail may also be coincided with the second dividing line L2. The "be coincided with" here refers to the theoretical coincidence, but there may be a coincidence degree error in actual processing, and all offsets within the processing error are within the protection scope of the present application. Referring to FIG. 8, in this embodiment, the first channel 10*a* is closer to the first tail 712 than the first head 711. Since the pressure of the working medium in the second area 102 gradually increases as the first rotor assembly 1 rotating, that is, the pressure of the working medium gradually increases from the first head 711 to the first tail 712. However, the first channel 10*a* is closer to the first tail 712 than the first head 711, which can relatively increase the pressure difference of the working medium entering the second accommodation cavity 900 in FIG. 7, so that the working medium can effectively flow into the second accommodation cavity 900 in FIG. 7, thereby further enabling the working medium to be in contact with the stator assembly inside the second accommodation cavity 900, thereby facilitating the heat dissipation of the stator assembly.

Referring to FIG. 8 to FIG. 11, the first groove 71 further includes a first side surface 713 and a second side surface 714. The first side surface 713 is closer to the center axis of the first rotor 11 than the second side surface 714. The first head 711 is located on one end of the first side surface 713 and one end of the second side surface 714; the first tail 712 is located on the other end of the first side surface 713 and the other end of the second side surface 714. Referring to FIG. 8 to FIG. 11, the first side surface 713 is closer to the center axis of the first rotor 11 than a tooth bottom of an external tooth of the first rotor 11, and the second side surface 714 is closer to a peripheral side wall of the first accommodation portion 80 than a tooth bottom of an internal tooth of the second rotor 12. Alternatively, in a case that the first rotor assembly 1 is orthographically projected to the bottom wall 802*a* of the first accommodation portion, a projection of the first side surface 713' is tangent to a projection of the tooth bottom of the external tooth of the first rotor 11, and a projection of the second side surface 714' is tangent to a projection of the tooth bottom of the internal tooth of the second rotor 12, in which the "tangent" refers to the theoretical tangent, but there may be errors in actual processing, and all offsets within the processing error and assembly error are within the protection scope of the present application. Referring to FIG. 8 and FIG. 9, the minimum distance between an outer peripheral edge of the first channel and the first side surface is greater than or equal to 0.2 mm, and the minimum distance between the outer peripheral edge of the first channel and the second side surface is greater than or equal to 0.2 mm. In this way, the first channel 10*a* may not damage the first side surface 713 and the second side surface 714. In this embodiment, the first side surface 713 and the second side surface 714 are arc-shaped, and the minimum distance between the first side surface 713 and the second side surface 714 gradually decreases from the first head 711 to the first tail 712. In this embodiment, the first side surface 713 and the second side surface 714 are smooth surfaces, that is, the first side surface 713 and the second side surface 714 are not provided with protrusion, recess or other structural features, the above "the minimum distance between the first side surface 713 and the second side surface 714" refers to the minimum distance between the smooth surface of the first side surface 713 and the smooth surface of the second side surface 714. In this way, during the operation of the electric pump, a volume of the working medium stored in the first groove 71 gradually decreases from the first head 711 to the first tail 712. This process of gradual decrease in volume and the process of volume change of the working medium in the second area 102 are the same, so that the working medium in the first groove 71 may also flow out with the working medium in the second area 102, which is beneficial for improving the efficiency of the pump.

Compared with the first embodiment of the electric pump, in this embodiment, the first casing 7*a* is provided with a first groove 71, at least part of the second area 102 is located inside the first groove 71. The first channel 10*a* is provided inside the first groove 71, and the first channel 10*a* penetrates through the bottom surface of the first groove 71 and the lower surface of the bottom wall 802*a* of the accommodation portion, so that the first groove 71 enables a part of the working medium to be located in the first groove 71 during the operation of the electric pump, so that an oil film may be formed between the first rotor assembly and the bottom wall 802*a*, thereby further being beneficial for reducing the friction between the first rotor assembly and the bottom wall 802*a* during rotation, and thereby being beneficial for reducing the noise caused by the friction. Other features of the electric pump in this embodiment may refer to the first embodiment of the electric pump, which will not be described herein.

Figure 12:
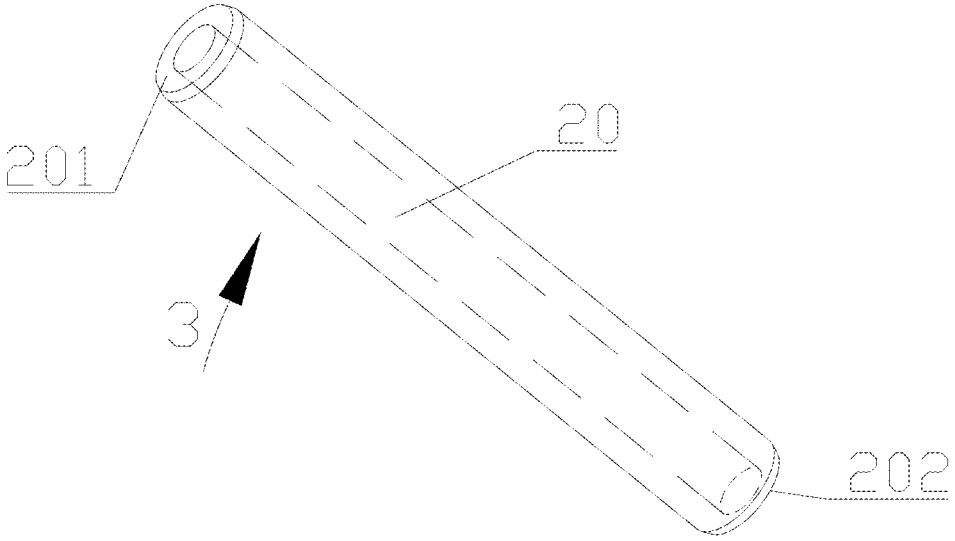
FIG. 12 is a three-dimension structural view of a pump shaft in FIG. 1 or FIG. 7.

The second channel in the first embodiment and the second embodiment of the electric pump will be described in detail below. Referring to FIG. 12, along the axial direction of the pump shaft 3, the second channel 20 is provided to penetrate through a first end surface 201 and a second end surface 202 of the pump shaft 30. In this embodiment, the cross-section of the second channel 20 is in the shape of a circular hole. Of course, the cross-section of the second channel 20 may also be in shape of a square hole or other shapes. Alternatively, the second channel 20 may also be in communication with the outer peripheral surface of the pump shaft 20. In this case, the second channel 20 is equivalent to an opening along the radial direction of the pump shaft 3. Specifically, in this embodiment, the center axis of the second channel 20 is coincided with the center axis of the pump shaft 3, in which the "be coincided with" here refers to the theoretical coincidence, but there may be a coincidence degree error in actual processing, and all offsets within the processing error are within the protection scope of the present application. With reference to FIG. 1, FIG. 7 and FIG. 10, a bore size of the first channel 10, 10*a* is smaller than or equal to a bore size of the second channel 20. Specifically, in this embodiment, a ratio of the bore size of the first channel 10, 10*a* to the bore size of the second channel 20 is greater than or equal to ⅕ and less than or equal to 1, so that on one hand, a flow rate of the working medium in the second accommodation cavity 900, flowing in the second channel 20, may be relatively reduced, which is beneficial for relatively prolonging the heat exchange time between the stator assembly and the working medium, and thereby being beneficial for the heat dissipation of the stator assembly; on the other hand, since the heat exchange time between the stator assembly and the working medium is relatively prolonged, which is equivalent to prolonging a residence time of the working medium in the second accommodation cavity, thereby being beneficial for relatively reducing a flow rate in a unit time of the working medium in the second accommodation cavity 900, and further being beneficial for reducing a flow loss of the working medium in the first accommodation cavity 800, which in turn is beneficial for improving the efficiency of the pump. Reference is made back to FIG. 1 and FIG. 7, the second channel 20 is configured to communicate the second accommodation cavity 900 with the branch channel 64, and the branch channel 64 is in communication with the outflow channel 62. In this embodiment, the outflow channel 62 and the branch channel 64 are located on the pump cover 6. The outflow channel 62 and the branch channel 64 will be described in detail below.

Reference is made to FIG. 13 to FIG. 17, which are schematic structural views of the first embodiment of the pump cover in FIG. 1 and FIG. 7. The first embodiment of the pump cover will be described in detail below.

Figure 13:
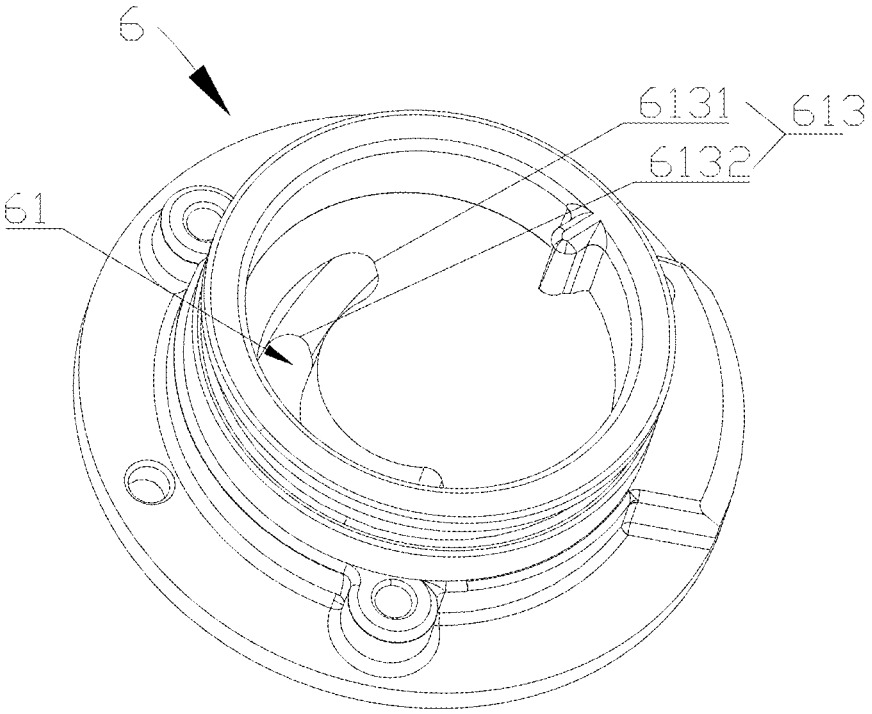
FIG. 13 is a three-dimension structural view of the first embodiment of a pump cover in FIG. 1 or FIG. 7 from a perspective.
Figure 14:
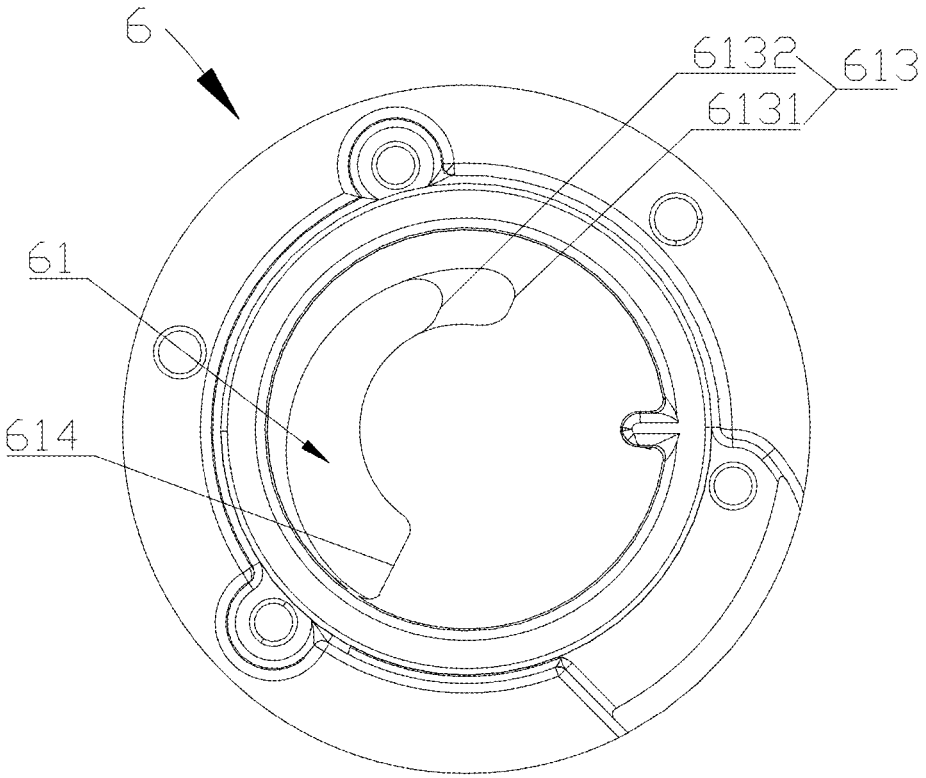
FIG. 14 is a schematic front view of the pump cover in FIG. 13.
Figure 15:
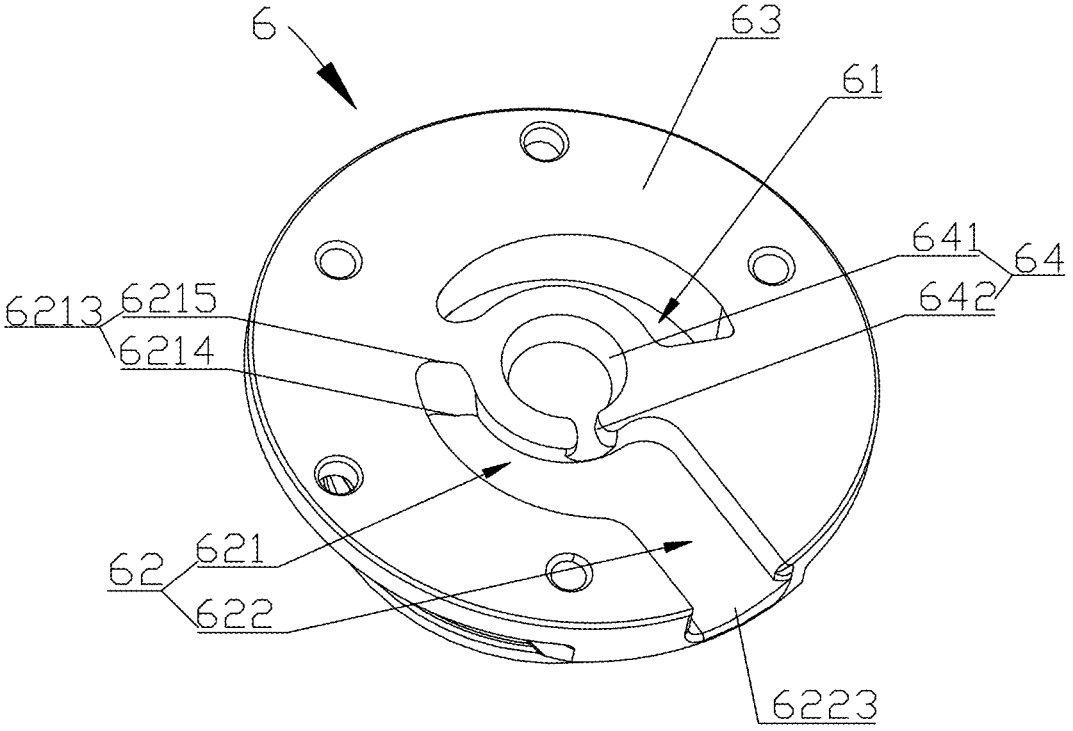
FIG. 15 is a three-dimension structural view of the first embodiment of the pump cover in FIG. 1 or FIG. 7 from another perspective.
Figure 16:
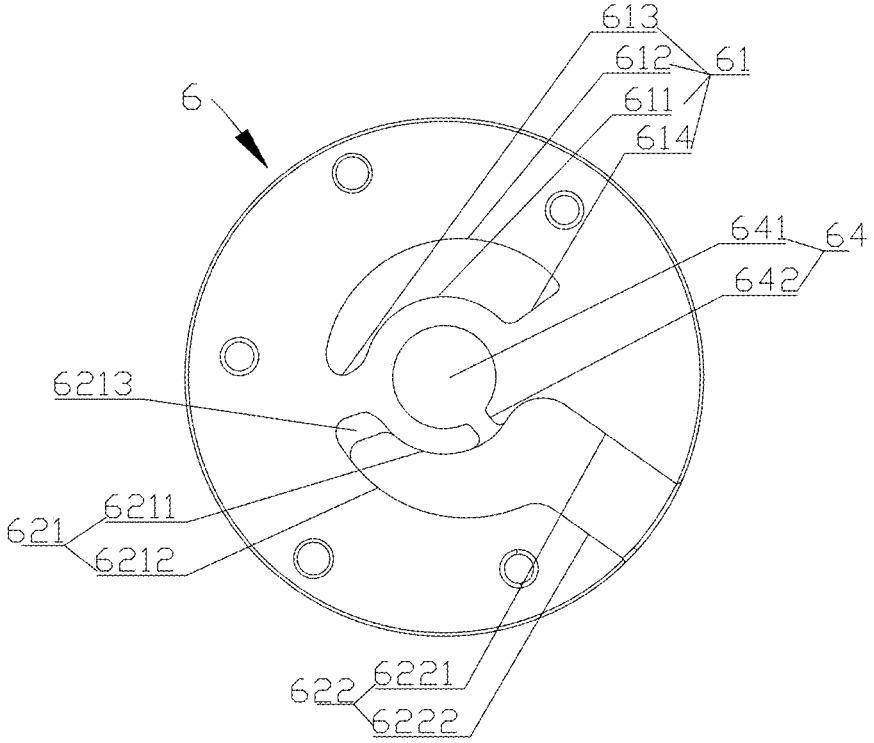
FIG. 16 is a schematic front view of the pump cover in FIG. 15.
Figure 17:
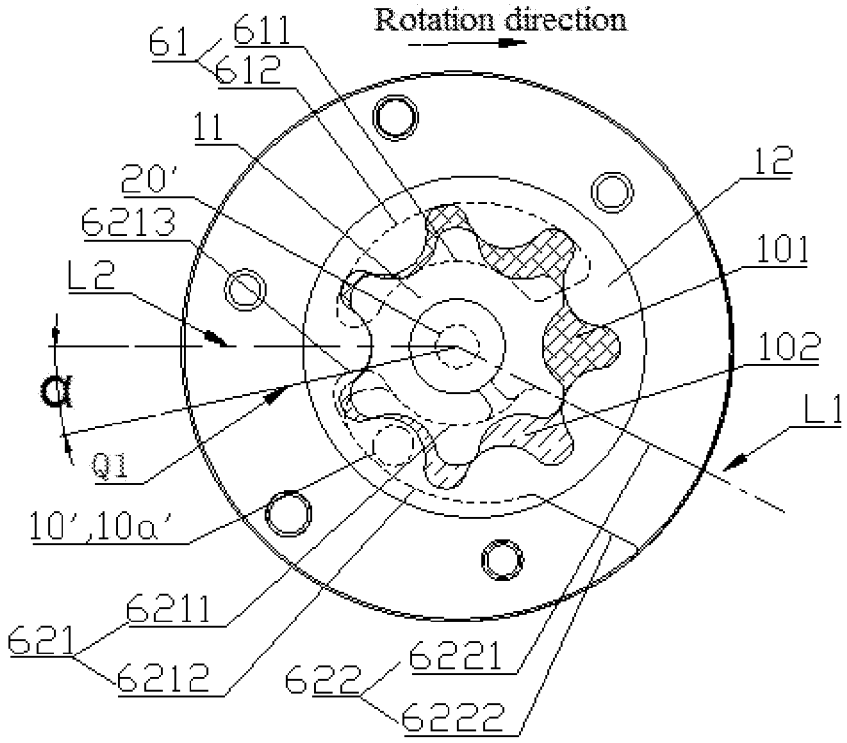
FIG. 17 is a schematic front view formed by projecting the first rotor assembly and the pump shaft in FIG. 1 or FIG. 7 to a lower end surface of the pump cover in FIG. 16.

Referring to FIG. 13 to FIG. 17, in this embodiment, the inflow channel 61, the outflow channel 62, and the branch channel 64 are all formed on the pump cover 6. Specifically, the inflow channel 61 penetrates through the upper end surface and the lower end surface of the pump cover 6. The outflow channel 62 is recessed from the lower end surface 63 of the pump cover 6, and along the axial direction of the pump cover 6, the outflow channel 62 does not penetrate through the upper end surface of the pump cover 6. Of course, parts or components other than the pump cover may be directly assembled with the gearbox of the vehicle. In this case, the outflow channel 62 and the inflow channel 61 may be formed on the gearbox correspondingly. Referring to FIG. 15 and FIG. 17, the first area 101 is in communication with the inflow channel 61; the first area 101 is not in communication with the outflow channel 62; the second area 102 is in communication with the outflow channel 62; and the second area 102 is not in communication with the inflow channel 61. In a case that the first rotor assembly 1, the inflow channel 61 and the outflow channel 62 are orthographically projected in a direction parallel to the upper end surface of the first rotor 11, a part of a projection of the first area 101 is located in a projection of the inflow channel 61; the projection of the first area 101 is not located in a projection of the outflow channel 62; and a projection of the second area 102 is located in the projection of the outflow channel 62, which is beneficial for preventing the working medium in the second area 102 from flowing to the first area 101, so as to reduce the flow loss and thereby improving the efficiency of the pump.

Referring to FIG. 15, the outflow channel 62 includes a first circulation portion 621 and a second circulation portion 622. The first circulation portion 621 is in communication with the second circulation portion 622. The second circulation portion 622 is closer to the outer edge of the pump cover 6 than the first circulation portion 621. The second circulation portion 622 penetrates through part of the outer edge of the pump cover 6 along the radial direction of the pump cover 6. The first circulation portion 621 and the second circulation portion 622 are connected in smooth transition, which is beneficial for the working medium to flow smoothly. Referring to FIG. 16 and FIG. 17, the first circulation portion 621 includes a first distal side wall 6212 and a first proximal side wall 6211, and the first proximal side wall 6211 is closer to the center axis of the first rotor 11 than the first distal side wall 6212. Referring to FIG. 17, in a case that the first rotor assembly 1, the inflow channel 61 and the outflow channel 62 are orthographically projected in the direction parallel to the upper end surface of the first rotor 11, a projection of the second area 102 is located between a projection of the first proximal side wall 6211 and a projection of the first distal side wall 6212. Specifically, the projection of the first proximal side wall 6211 is tangent to a projection of a tooth bottom of an external tooth of the first rotor 11, or the projection of the first proximal side wall 6211 is closer to a bore edge of the first rotor 11 than a tooth bottom of an internal tooth of the projection of the first rotor 11; a projection of the first distal side wall 6212 is tangent to a projection of a tooth bottom of an internal tooth of the second rotor 12, or the projection of the first distal side wall 6212 is closer to an outer edge of the second rotor 12 than a tooth bottom of an internal tooth of the projection of the first rotor 12, where the "tangent" refers to the theoretical tangent, but there may be errors in actual processing, and all offsets within the processing error and assembly error are within the protection scope of the present application. The second area 102 is located in the first circulation portion 621 through the above method, which on the one hand is beneficial for preventing the working medium in the second area from flowing through the first circulation portion 621 to the first area 101, so as to be beneficial for reduce the flow loss of the outlet of the pump, thereby improving the efficiency of the pump; on the other hand, a part of the working medium in the second area 102 is squeezed to a position with the smallest volume after being squeezed, and flows out along an extension direction of the first circulation portion 621. There is another part of the working medium that does not have to wait to be squeezed to the position with the smallest volume before being drained out. Instead, another part of the working medium flows into the first circulation portion through the corresponding volume cavity and then is discharged to the outlet of the electric pump, which is beneficial for relatively increasing the outlet flow of the electric pump, thereby being beneficial for improving the efficiency of the pump.

Referring to FIG. 15, the second circulation portion 622 includes a second distal side wall 6222 and a second proximal side wall 6221. The second proximal side wall 6221 and the first proximal side wall 6211 are connected in smooth transition; the second distal side wall 6222 and the first proximal side wall 6221 are connected in smooth transition. In a case that the outflow channel 62 and the first rotor assembly 1 are orthographically projected in the direction parallel to the upper end surface of the first rotor 11, a projection of the second proximal side wall 6221 is not located inside the first area 101. Specifically, in this embodiment, the projection of the second proximal side wall 6221 is coincided with the first dividing line L1, The "be coincided with" here refers to the theoretical coincidence, but there may be errors in actual processing, and all offsets within the scope of the processing error and the assembly error are within the protection scope of the present application. Of course, the projection of the second proximal side wall 6221 may not be coincided with the first dividing line L1. In this case, the projection of the second proximal side wall 6221 may pass through the first engaging point A or a point near the first engaging point A, as long as it is ensured that the projection of the second proximal side wall 6221 is not located in the first area 101. The outflow channel 62 is not in communication with the first area 101 through above arrangement, thereby being beneficial for preventing the working medium from being leaked into the first area 101 from the outflow channel 62, so as to be beneficial for reducing the flow loss of the outlet, and thereby being beneficial for improving the efficiency of the pump. Referring to FIG. 15, in this embodiment, a recess depth of the first circulation portion 621 is equal to a recess depth of the second circulation portion 622, that is, a bottom surface of the first circulation portion 621 and a bottom surface of the second circulation portion 622 are in the same plane.

Referring to FIG. 15 and FIG. 16, in this embodiment, the first proximal side wall 6211 and the first distal side wall 6212 are both arc-shaped, which is beneficial for the flow of the working medium. In addition, in this embodiment, the first proximal side wall 6211 is coaxially provided with the first rotor 11, and the first distal side wall 6212 is coaxially provided with the second rotor 12, in which the "coaxially" refers to the theoretically coaxiality, but there may be errors in the actual processing or assembly of parts, all the coaxiality errors within the scope of processing error and assembly error are within the protection scope of the present application. Referring to FIG. 15, the first circulation portion further includes a first front end 6213. A vertical distance between the first proximal side wall 6211 and the first distal side wall 6212 gradually increases from the first front end 6213 to a transitional junction of the first circulation portion 621 and the second circulation portion 622, which is beneficial for the working medium to flow smoothly. On one hand, it is beneficial for reduce the noise; on the other hand, it is beneficial for reduce the pressure loss of the working medium in the first circulation portion. Referring to FIG. 15 and FIG. 16, the second circulation portion 622 further includes a second rear end 6223, which is an opening end of the second circulation portion 622, located on the outer edge of the pump cover 6, and forms a part of the outlet of the electric pump. A vertical distance between the second proximal side wall 6221 and the second distal side wall 6222 remains unchanged from the transitional junction of the first circulation portion 621 and the second circulation portion 622 to the second rear end 6223. Specifically, referring to FIG. 15 and FIG. 16, in this embodiment, the second proximal side wall 6221 and the second distal side wall 6222 is flat, and the second proximal side wall 6221 and the second distal side wall 6222 are provided in parallel. Of course, the vertical distance between the second proximal side wall 6221 and the second distal side wall 6222 may also gradually increases from the transitional junction of the first circulation portion 621 and the second circulation portion 622 to the second rear end 6223.

Referring to FIG. 15 and FIG. 17, in a case that the first rotor assembly 1, the inflow channel 61 and the outflow channel 62 are orthographically projected in the direction parallel to the upper end surface of the first rotor 11, and a tangent line Q1 of a projection of the first front end 6213 is drawn through the center of the projection of the first rotor 11, an angle $\alpha$ between the tangent line Q1 and the second dividing line L2 is greater than or equal to 8 degrees and less than or equal to 19 degrees. In this case, on one hand, the first circulation portion 621 is effectively prevented from being in communication with the first area 101; on the other hand, it is beneficial for relatively increasing a communication area between the second area 102 and the first circulation portion 621, so as to make the working medium in the second area 102 flow out from the first circulation portion 62 as much as possible, which in turn is beneficial for relatively increasing the outlet flow of the pump, thereby being beneficial for improving the efficiency of the pump.

Referring to FIG. 15 and FIG. 16, the first front end 6213 includes a first upper end 6214 and a first lower end 6215. Along the axial direction of the electric pump, the first lower end 6215 is closer to the first rotor assembly 1 than the first upper end 6214; along the extension direction of the outflow channel 62, the first upper end 6214 is closer to the second circulation portion 622 than the first lower end 6215. The surface of the first front end 6213 is inclined; the first front end 6213 is inclined from the first upper end 6214 to the first lower end 6215. In this embodiment, the first lower end 6215 is formed on the lower end surface 63 of the pump cover 6, and the first upper end 6214 is formed on the bottom surface of the first circulation portion 621, so that the first front end 6213 is beneficial for guide the working medium at the smallest volume cavity in the second area 102 into the first circulation portion 621, so that the working medium at the smallest volume cavity in the second area 102 smoothly enters the first circulation portion 621, which in turn is beneficial for reduce the generation of vacuum holes.

Referring to FIG. 15 and FIG. 16, the pump cover 6 also includes the branch channel 64, which is recessed from the lower end surface of the pump cover 6, and does not penetrate through the upper end surface of the pump cover 6 along the axial direction of the pump cover 6. The inflow channel 61 is located on one side of the branch channel 64, and the outflow channel 62 is located on the other side of the branch channel 64. The branch channel 64 is located between the first proximal side wall 6122 of the first circulation portion 621 and the inflow channel 61. With reference to FIG. 1, FIG. 7, FIG. 15 and FIG. 16, one side of the branch channel 64 is in communication with the outflow channel 62, the other side of the branch channel 64 is in communication with the second channel 20, so that the branch channel 64 enables the second channel 20 to be in communication with the outflow channel 62, so that the working medium in the second accommodation cavity 900 is enabled to flow into the outflow channel 62 through the second channel 20 and the branch channel 64, and then to be drained out along the extension direction of the outflow channel 62. This way of draining the working medium in the second accommodation cavity 900 to the outflow channel 62 is beneficial for increase the outlet flow rate of the pump, which in turn is beneficial for improve the efficiency of the pump.

Referring to FIG. 15 and FIG. 16, specifically, the branch channel 64 is in communication with the first circulation portion 621. In this embodiment, the branch channel 64 includes a first communicating portion 641 and a second communicating portion 642, in which the first communicating portion 641 is in direct communication with the second channel 20. Along the radial direction of the pump cover 6, the second communicating portion 642 is provided to penetrate through the first proximal side wall 6211 and a part of the peripheral side wall of the first communicating portion 641, so that the first communicating portion 641 is in communication with the first circulation portion 621. Referring to FIG. 15 and FIG. 16, a circulation cross-sectional area of the second communicating portion 642 is smaller than that of the first communicating portion 641, or a diameter of the second communicating portion 642 is smaller than that of the first communicating portion 641, which is beneficial for relatively reduce a flow velocity of the working medium in the branch channel 64 into the outflow channel 62. Since the branch channel 64 is in communication with the second accommodation cavity 900 in FIG. 1 or FIG. 7 through the second channel 20, the flow velocity of the working medium flowing from the second accommodation cavity 900 to the second channel 20 will be relatively reduced, so that in a case that the second accommodation cavity 900 is fulfilled with working medium, the flow velocity of a part of the working medium in the first accommodation cavity 800 flowing into the second accommodation cavity 900 will further be relatively reduced, which in turn is beneficial for prolonging a residence time of the working medium in the second accommodation cavity 900, so as to relatively increase the flow rate of the working medium flowing along the first flowing direction shown in FIG. 1 or FIG. 7 within a certain period of time, thereby being beneficial for improving the efficiency of the pump. Referring to FIG. 15, in this embodiment, the second communicating portion 642 is provided to be closer to the transitional junction of the first circulation portion 621 and the second circulation portion 622 than the first front end 6213, so that the pressure of the working medium near the first front end 6213 is greater than the pressure of the working medium near the transitional junction of the first circulation portion 621 and the second circulation portion 622. With Reference to FIG. 1, FIG. 7, FIG. 16 and FIG. 17, the projections 10', **10*a*' of the first channel are closer to the first front end 6213 than the second communicating portion 642, so that the pressure of the working medium at an outlet of the second communicating portion 642 is lower than that of the working medium in the inlet of the first channel 10, 10*a*, so that a pressure difference may be formed between the outlet of the second communicating portion 642 and the inlet of the first channel 10, 10*a***, which is beneficial for enable the working medium in the second accommodation cavity to flow out.

Referring to FIG. 15, in this embodiment, a recess depth of the second communicating portion 642 is equal to a recess depth of the first communicating portion 641, that is, the bottom surface of the second communicating portion 642 and the bottom surface of the first communicating portion 641 are on the same plane, which is beneficial for the working medium to flow smoothly in the branch channel. In addition, referring to FIG. 15, in this embodiment, the recess depth of the branch channel 64 is smaller than the recess depth of the first circulation portion 621, which is beneficial for relatively reducing the working medium accumulated in the branch channel 64 in a unit time. Since the branch channel 64 is in communication with the second accommodation cavity 900 in FIG. 1 or FIG. 7 through the second channel 20, the residence time of the working medium that in the second accommodation cavity 900 and being accumulated in the branch channel 64 may be relatively prolonged, which is beneficial for relatively prolonging the residence time of the working medium in the second accommodation cavity 900, and thereby being beneficial for relatively reducing the flow rate of a part of the working medium flowing from the first accommodation cavity 800 into the second accommodation cavity 900. Further, the flow rate of the working medium flowing along the first flowing direction shown in FIG. 1 or FIG. 7 within a certain period of time is relatively increased, thereby being beneficial for improving the efficiency of the pump. Of course, the recess depth of the branch channel 64 may also be equal to the recess depth of the first circulation portion 621.

Referring to FIG. 15 to FIG. 17, in a case that the second channel 20 is orthographically projected to the lower end surface 63 of the pump cover 6, a projection 20' of the second channel is located in the first communicating portion 641, which is beneficial for enabling the second channel 20 to be in sufficient communication with the first circulation portion 641.

Referring to FIG. 13 to FIG. 17, the inflow channel 61 penetrates through the upper end surface and the lower end surface of the pump cover 6 along the axial direction of the pump cover 6. The inflow channel 61 includes a third proximal side wall 611 and a third distal side wall 612, where the third proximal side wall 611 is closer to the center axis of the first rotor than the third distal side wall 612. Referring to FIG. 17, in a case that the first rotor assembly 1 and the inflow channel 61 are orthographically projected in the direction parallel to the upper end surface of the first rotor 11, a projection of the third distal side wall 612 is tangent to a projection of a tooth bottom of an internal tooth of the second rotor 12; a projection of the third proximal side wall 611 is tangent to a projection of a tooth bottom of an internal tooth of the first rotor 11, in which the "tangent" refers to the theoretical tangent, but there may be errors in actual processing and assembly, and all offsets within the processing error and assembly error are within the protection scope of the present application. Of course, the projection of the third distal side wall 612 may also closer to the outer edge of the second rotor 12 than the projection of the tooth bottom of the internal tooth of the rotor 12, and the projection of the third proximal side wall 611 may also be closer to the bore edge of the first rotor 11 than the projection of the tooth bottom of the internal tooth of the first rotor 11. In this way, at least part of the projection of the first area 101 is located in the projection of the inflow channel 61, and two boundaries of the projection of the first area 101 will not cross the projection of the third proximal side wall 611 and the projection of the third distal side wall 612, so that the working medium in the inflow channel 61 can effectively flow into the first area 101, which is beneficial for further improving the efficiency of the pump.

Referring to FIG. 16 and FIG. 17, the inflow channel 61 further includes a third front end 613 and a third rear end 614, where the third front end 613 is closer to the first front end 6213 of the first circulation portion than the third rear end 614. A vertical distance between the third proximal side wall 611 and the third distal side wall 612 gradually increases from the third front end 613 to the third rear end 614. In this way, along the rotation direction of the first rotor assembly, a process of volume change in the inflow channel 61 and a process of volume change of the working medium in the first area 101 are the same, in a case that the working medium enters the first area through the inflow channel 61, which is beneficial for relatively increasing the flow rate of working medium entering the first area in a unit time, thereby being beneficial for improving the efficiency of the pump.

Referring to FIG. 13 and FIG. 14, the third front end 613 further includes a second upper end 6131 and a second lower end 6132, in which the second upper end 6131 is formed the upper end surface of the pump cover, and the second lower end 6132 is formed on the lower end surface of the pump cover. Along the circumferential direction of the pump cover, the second lower end 6215 is closer to the third rear end 614 than the second upper end 6131. The surface of the third front end 613 is inclined. Referring to FIG. 14 and FIG. 17 in combination, the inclined arrangement of the third front end 613 is beneficial for guide the working medium in the inflow channel 71 to the first area 101, which is beneficial for the working medium to flow smoothly from the inflow channel 61 to the first area 101, thereby being beneficial for reduce the generation of vacuum holes.

Figure 18:
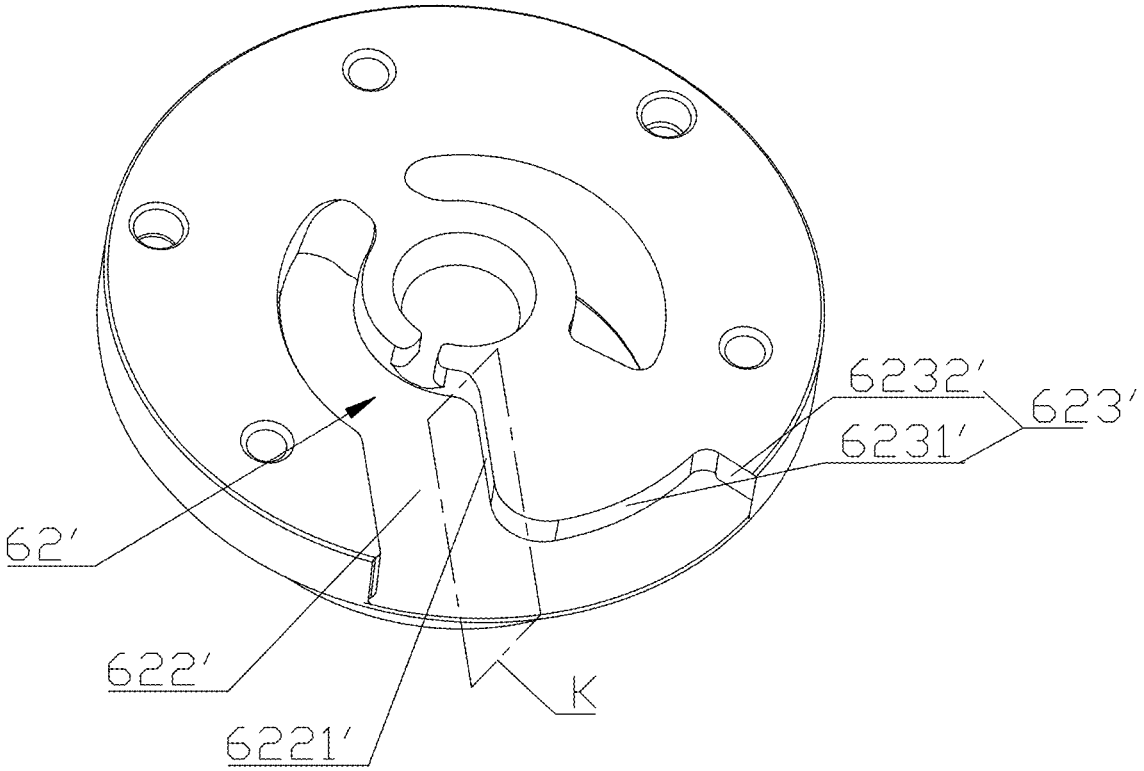
FIG. 18 is a three-dimension structural view of the second embodiment of the pump cover in FIG. 1 or FIG. 7 in a direction.
Figure 19:
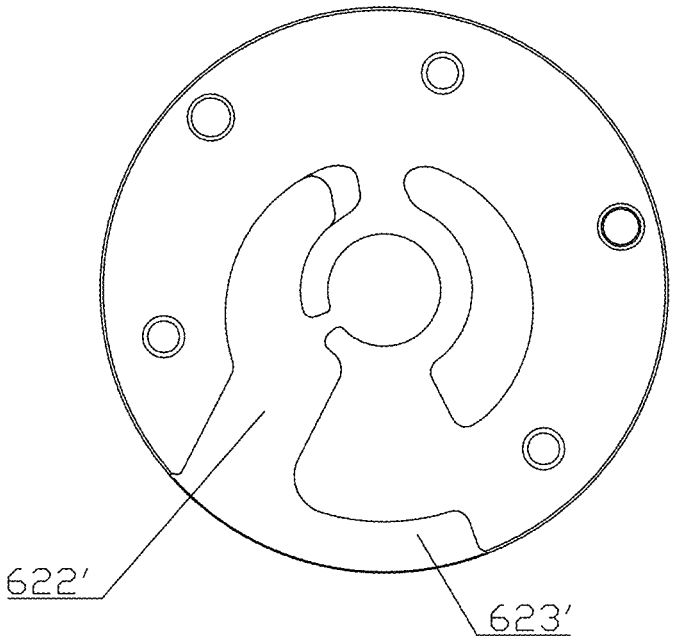
FIG. 19 is a schematic front view of the pump cover in FIG. 18.

Referring to FIG. 18 to FIG. 19, FIG. 18 to FIG. 19 are structural schematic views of the second embodiment of the pump cover in FIG. 1 or FIG. 7. The second embodiment of the pump cover will be described in detail below.

Referring to FIG. 18 and FIG. 19, in this embodiment, the outflow channel 62' further includes a third circulation portion 623', which is in direct communication with a second circulation portion 622'. Along the radial direction of the pump cover 6, the third circulation portion 623' penetrates through part of the outer edge of the pump cover 6. Referring to FIG. 19, in order to facilitate the description of the third circulation portion 623', a dividing interface is introduced herein. A second proximal side wall 6221' is located in the dividing interface K. The interface K is parallel to the second proximal side wall 6221'. The second circulation portion 622' is located on one side of the interface K, and the third circulation portion 623' is located on the other side of the interface K. The third circulation portion 623' includes a fourth proximal side wall 6231' and a fifth proximal side wall 6232', where the fourth proximal side wall 6231' and the second proximal side wall 6221' are connected in a smooth transition; the fifth proximal side wall 6232' and the fourth proximal side wall 6231' are connected in a smooth transition; the fifth proximal side wall 6232' is connected to the outer edge of the pump cover. In this embodiment, the third circulation portion 623' is provided for enabling the electric pump to meet the interface requirements of relatively large diameters.

Compared with the first embodiment of the pump cover, in this embodiment, the pump cover further includes the third circulation portion 623'. By providing the third circulation portion 623', the electric pump can meet the interface requirements of relatively large diameters. For other features of the pump cover in this embodiment, reference may be made to the first embodiment of the pump cover, which will not be described herein.

The above embodiments are only used to illustrate the present application rather than limit the technical solutions described in the present application. Although the present application is described in detail in this specification with reference to the above embodiments, those of ordinary skill in the art should understand that those skilled in the art may still modify or equivalently replace the present application, and all technical solutions and improvements thereof that do not depart from the spirit and scope of the present application shall be covered within the scope of the claims of the present application.

What is claimed is:

1. An electric pump comprising a pump shaft, a first rotor assembly, a stator assembly, and a second rotor assembly; wherein one end of the pump shaft is fixedly connected to a part of the first rotor assembly, and the other end of the pump shaft is connected to the second rotor assembly; a first accommodation portion and a second accommodation portion are provided on the electric pump, the first accommodation portion is provided with a first accommodation cavity, and the second accommodation portion is provided with a second accommodation cavity; the first rotor assembly is provided in the first accommodation cavity, the stator assembly and the second rotor assembly are provided in the second accommodation cavity; the first accommodation portion comprises a bottom wall for supporting the first rotor assembly; the electric pump comprises a first channel that penetrates through an upper surface and a lower surface of the bottom wall, the first channel is configured to communicate the first accommodation cavity with the second accommodation cavity; a working medium is circulatable in the first accommodation cavity, and at least part of the working medium inside the first accommodation cavity is flowable into the second accommodation cavity through the first channel and is contactable with at least part of the stator assembly located inside the second accommodation cavity; wherein the electric pump further comprises a second channel provided to penetrate through a first end surface and a second end surface of the pump shaft, and the second channel is configured to allow the working medium in the second accommodation cavity to leave the second accommodation cavity; the electric pump further comprises an inflow channel and an outflow channel, the inflow channel is used for an inflow of the working medium, and the outflow channel is used for an outflow of the working medium; an outlet of the second channel is closer to the inflow channel than an inlet of the first channel, and a pressure of the working medium at the outlet of the second channel is lower than a pressure of the working medium at the inlet of the first channel; the electric pump further comprises a branch channel for communicating the outflow channel with the second channel, wherein the first rotor assembly comprises a first rotor and a second rotor; the first rotor is provided with a plurality of external teeth, and the second rotor is provided with a plurality of internal teeth; the first rotor is located on an outer circumference of the second rotor, and the first rotor is connected to the ump shaft; an engaging between at least art of the external teeth of the first rotor and at least part of the internal teeth of the second rotor allows transmission between the first rotor and the second rotor; volume cavities are formed between the external teeth of the first rotor and the internal teeth of the second rotor, and each of the volume cavities is divided into a first area and a second area; in the first area, along a rotation direction of the first rotor assembly, a volume of a volume cavity formed between an external tooth of the first rotor and an internal tooth of the second rotor corresponding to the external tooth gradually increases; in the second area, along the rotation direction of the first rotor assembly, the volume of the volume cavity formed between an external tooth of the first rotor and an internal tooth of the second rotor corresponding to the external tooth gradually decreases; in a case that the first rotor assembly is orthographically projected to the bottom wall, at least part of a projection of the first channel is located inside the second area.

2. The electric pump according to claim 1, wherein in a case that the first rotor assembly is orthographically projected to the bottom wall, a first dividing line is defined in a projection of the first rotor assembly, a first engaging point is formed at the first dividing line by an external tooth of the first rotor engaging with an internal tooth of the second rotor, and the first dividing line is a line connecting the first engaging point and a center of the first rotor; a second dividing line is defined, a second engaging point is formed at the second dividing line by another external tooth of the first rotor engaging with another internal tooth of the second rotor, and the second dividing line is a line connecting the second engaging point and the center of the first rotor; the first dividing line and the second dividing line are dividing lines between the first area and the second area, wherein the first dividing line is served as a dividing line between an ending of the first area and a beginning of the second area, and the second dividing line is served as a dividing line between a beginning of the first area and an ending of the second area; the projection of the first channel is located closer to the second dividing line than the first dividing line.

3. The electric pump according to claim 1, wherein a first groove is defined on the bottom wall, and the first groove recesses from an upper surface of the bottom wall to a lower surface of the bottom wall, and the first groove does not penetrate through the lower surface of the bottom wall; in a case that the first rotor assembly is orthographically projected to the bottom wall, a projection of the second area is located inside a projection of the first groove; the first channel is located inside the first groove, and the first channel penetrates through a bottom surface of the first groove and the bottom surface of the bottom wall.

4. The electric pump according to claim 3, wherein the first groove comprises a first head and a first tail; during the operation of the electric pump, along the rotation direction of the first rotor assembly, in the second area, the working medium flows from the first head to the first tail; in a case that the first rotor assembly is orthographically projected to the bottom wall, a first dividing line is defined in a projection of the first rotor assembly, a first engaging point is formed at the first dividing line by an external tooth of the first rotor engaging with an internal tooth of the second rotor, and the first dividing line is a line connecting the first engaging point and a center of the first rotor; a second dividing line is defined, a second engaging point is formed at the second dividing line by another external tooth of the first rotor engaging with another internal tooth of the second rotor, and the second dividing line is a line connecting the second engaging point and the center of the first rotor; the first dividing line and the second dividing line are dividing lines between the first area and the second area, wherein the first dividing line is served as a dividing line between an ending of the first area and a beginning of the second area, and the second dividing line is served as a dividing line between a beginning of the first area and an ending of the second area; a projection of the first head coincides with the first dividing line or the projection of the first head is closer to the first dividing line than the second dividing line, and a projection of the first tail coincides with the second dividing line or the projection of the first tail is closer to the second dividing line than the first dividing line; the first channel is closer to the first tail than the first head.

5. The electric pump according to claim 4, wherein the first groove further comprises a first side surface and a second side surface; the first side surface is closer to a center axis of the first rotor than the second side surface; the first head is located at one end of the first side surface and one end of the second side surface, and the first tail is located at the other end of the first side surface and the other end of the second side surface; the first side surface is closer to the center axis of the first rotor than a tooth bottom of an external tooth of the first rotor, and the second side surface is closer to a peripheral side wall of the first accommodation portion than a tooth bottom of an internal tooth of the second rotor; or in a case that the first rotor assembly is orthographically projected to the bottom wall, a projection of the first side surface is tangent to a projection of the tooth bottom of the external tooth of the first rotor, and a projection of the second side surface is tangent to a projection of the tooth bottom of the internal tooth of the second rotor; a minimum distance between an outer peripheral edge of the first channel and the first side surface is greater than or equal to 0.2 mm, and a minimum distance between the outer peripheral edge of the first channel and the second side surface is greater than or equal to 0.2 mm.

6. The electric pump according to claim 5, wherein the first side surface and the second side surface are arc-shaped, and a minimum distance between the first side surface and the second side surface gradually decreases from the first head to the first tail.

7. The electric pump according to claim 1, wherein a cross section of the first channel and a cross section of the second channel are both circular holes, and a bore size of the first channel is smaller than or equal to a bore size of the second channel.

8. The electric pump according to claim 7, wherein the electric pump further comprises a first casing; at least a part of the first accommodation portion and at least a part of the second accommodation portion are defined on the first casing, the first accommodation cavity is located on one side of the bottom wall, and the second accommodation cavity is located on the other side of the bottom wall; the first casing comprises a pump shaft supporting portion formed integrally with the bottom wall; the pump shaft supporting portion protrudes from the lower surface of the bottom wall in a direction away from the lower surface of the bottom wall, and the pump shaft passes through the pump shaft supporting portion; a center axis of the second channel coincides with a center axis of the pump shaft, and the second channel is configured to communicate the second accommodation cavity with the branch channel.

9. The electric pump according to claim 8, wherein the electric pump further comprises a pump cover provided with the inflow channel, the outflow channel, and the branch channel; the inflow channel penetrates through upper and lower end surfaces of the pump cover; the outflow channel is recessed from the lower end surface of the pump cover, and the outflow channel does not penetrate through an upper end surface of the pump cover along an axial direction of the pump cover; the branch channel is recessed from the lower end surface of the pump cover, and the branch channel does not penetrate through an upper end surface of the pump cover along an axial direction of the pump cover; the inflow channel is located on one side of the branch channel, and the outflow channel is located on the other side of the branch channel.

10. The electric pump according to claim 9, wherein a recess depth of the branch channel is smaller than or equal to a recess depth of the outflow channel; the branch channel comprises a first communicating portion and a second communicating portion; the first communicating portion is in direct communication with the second channel; in a case that the second channel is orthographically projected to the lower end surface of the pump cover, a projection of the second channel is located inside the first communicating portion; the outflow channel comprises a first circulation portion and a second circulation portion; the second circulation portion is closer to an outer edge of the pump cover than the first circulation portion, the first circulation portion and the second circulation are connected in smooth transition; along a radial direction of the pump cover, the second circulation portion penetrates through part of the outer edge of the pump cover; the branch channel is in communication with the first circulation portion.

11. The electric pump according to claim 10, wherein the second communicating portion is in communication with the second channel; in a case that the second channel is orthographically projected to the lower end surface of the pump cover, the projection of the second channel is located inside the first communicating portion; along a radial direction of the pump cover, the second communicating portion is provided to penetrate through a first proximal side wall and a part of a peripheral side wall of the first communicating portion, and the second communicating portion is closer to a transitional junction of the first circulation portion and the second circulation portion than a first front end of the first circulation portion.

12. The electric pump according to claim 1, wherein in a case that the first rotor assembly is orthographically projected to an upper end surface parallel to the first rotor, a first dividing line is defined in a projection of the first rotor assembly, and a first engaging point is formed at the first dividing line by an external tooth of the first rotor engaging with an internal tooth of the second rotor; the first dividing line is a line connecting the first engaging point and a center of the first rotor, and the first dividing line is served as a dividing line between an ending of the first area and a beginning of the second area;

the first area is in communication with the inflow channel, and the first area is not in communication with the outflow channel; the second area is in communication with the outflow channel, and the second area is not in communication with the inflow channel; in a case that the first rotor assembly, the inflow channel, and the outflow channel are orthographically projected in a direction toward the upper end surface parallel to the first rotor, part of a projection of the first area is located inside a projection of the inflow channel, the projection of the first area is not located in a projection of the outflow channel, and a projection of the second area is located inside the projection of the outflow channel.

13. The electric pump according to claim 12, wherein the outflow channel comprises a second circulation portion; the first circulation portion is connected to the second circulation portion in a smooth transition, the second circulation portion is closer to an outlet of the electric pump than the first circulation portion, and the first circulation portion is in communication with the second circulation portion; the first circulation portion comprises a first distal side wall and a first proximal side wall, wherein the first proximal side wall is closer to a center axis of the first rotor than the first distal side wall; in a case that the first rotor assembly and the first circulation portion are orthographically projected in a direction toward the upper end surface parallel to the first rotor, a projection of the first proximal side wall is tangent to a projection of a tooth bottom of an external tooth of the first rotor, or the projection of the first proximal side wall is closer to a bore edge of the first rotor than a projection of a tooth bottom of an internal tooth of the first rotor; a projection of the first distal side wall is tangent to a projection of a tooth bottom of an internal tooth of the second rotor, or the projection of the first distal side wall is closer to an outer edge of the second rotor than a projection of a tooth bottom of an internal tooth of the first rotor.

14. The electric pump according to claim 13, wherein the first proximal side wall and the first distal side wall are arc-shaped, the first proximal side wall and the first rotor are arranged coaxially, and the first distal side wall and the second rotor are arranged coaxially; the first circulation portion further comprises a first front end; a vertical distance between the first proximal side wall and the first distal side wall gradually increases from the first front end to a transitional junction of the first circulation portion and the second circulation portion.

15. The electric pump according to claim 6, wherein a cross section of the first channel and a cross section of the second channel are both circular holes, and a bore size of the first channel is smaller than or equal to a bore size of the second channel.

* * * * *